US007230380B2

(12) United States Patent
Hur et al.

(10) Patent No.: US 7,230,380 B2
(45) Date of Patent: Jun. 12, 2007

(54) PLASMA DISPLAY PANEL

(75) Inventors: Min Hur, Suwon-si (KR); Hoon-Young Choi, Suwon-si (KR); Young-Do Choi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 60 days.

(21) Appl. No.: 11/251,847

(22) Filed: Oct. 18, 2005

(65) Prior Publication Data

US 2006/0091805 A1 May 4, 2006

(30) Foreign Application Priority Data

Oct. 28, 2004 (KR) ..... 10-2004-0086644
Nov. 19, 2004 (KR) ..... 10-2004-0095002

(51) Int. Cl.
*H01J 17/49* (2006.01)

(52) U.S. Cl. ..... 313/584; 313/495; 313/496; 313/497

(58) Field of Classification Search ..... 313/584
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa (Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—David Bruce
*Assistant Examiner*—Conrad R. Blease
(74) *Attorney, Agent, or Firm*—Robert E. Bushnell, Esq.

(57) ABSTRACT

A plasma display panel is provided in which a sustain discharge is induced in response to an opposed discharge generated between a pair of electrodes, thereby reducing a discharge firing voltage and improving efficiency. The plasma display panel includes a first substrate and a second substrate disposed to face each other, a space between the first substrate and the second substrate being divided into a discharge cell, a phosphor layer formed in the discharge cell, an address electrode formed on the first substrate in a first direction, and a first electrode and a second electrode formed on the first substrate in a second direction crossing the first direction. The first electrode and the second electrode are electrically isolated from the address electrode and corresponding to the discharge cell to face each other with a space therebetween. A shape of the first electrode is substantially different from a shape of the second electrode.

20 Claims, 21 Drawing Sheets

U.S. PATENT DOCUMENTS

| | | | |
|---|---|---|---|
| 5,674,553 | A | 10/1997 | Sinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| JP | 3421669 | 4/2003 |
| JP | 2003-338247 | 11/2003 |
| KR | 10-2001-0107186 | 12/2001 |

PLASMA DISPLAY PANEL

CLAIM OF PRIORITY

This application makes reference to, incorporates the same herein, and claims all benefits accruing under 35 U.S.C. §119 from applications for PLASMA DISPLAY PANEL earlier filled in the Korean Intellectual Property Office on Oct. 28, 2004 and Nov. 19, 2004 and there duly assigned Ser. Nos. 10-2004-0086644 and 10-2004-0095002, respectively.

BACKGROUND OF THE INVENTION

1. Technical Field

The present invention relates to a plasma display panel (PDP). More particularly, the present invention relates to a plasma display panel in which a sustain discharge can be induced by an opposed discharge.

2. Description of the Related Art

Generally, a plasma display panel (PDP) is a display device in which vacuum ultraviolet (VUV) rays emitted from plasma by gas discharge excite phosphors to generate visible light, thereby crating images. As the plasma display panel enables a wide screen with a high resolution, it has been in the spotlight as a future generation flat panel display.

A plasma display panel of a three-electrode surface-discharge structure may be taken as an example of a general plasma display panel. In the three-electrode surface-discharge structure, display electrodes are formed on a front substrate by pairs, and address electrodes are formed on a rear substrate apart from the front substrate by a predetermined gap. A space between the front substrate and the rear substrate is divided into a plurality of discharge cells by barrier ribs. In each discharge cell, a phosphor layer is formed on the rear substrate. Discharge gas is filled in the discharge cells.

Whether a discharge cell is to be discharged or not is determined by an address discharge between the address electrode and one of the display electrodes. A sustain discharge, by which an image is actually displayed, is achieved by the display electrodes formed on the same plane. That is, the address discharge is induced by an opposed discharge, and the sustain discharge is induced by a surface discharge.

Though a length between one of the display electrodes and the address electrode is larger than the length between the display electrodes, a discharge firing voltage of the address discharge is smaller than a discharge firing voltage of the sustain discharge. It has been known that, since the address discharge is induced by an oppose discharge, the discharge firing voltage of the address discharge is smaller than that of the sustain discharge which is induced by a surface discharge. Accordingly, it can be seen that a plasma display panel capable of generating a sustain discharge by an opposed discharge has higher efficiency than a conventional plasma display panel.

A discharge space in a plasma display panel is divided into a sheath region and a positive column region by the discharge generated in a plasma display panel. The sheath region is a non-emitting region which is formed to surround electrodes or dielectric layers and most of the voltage is consumed in the sheath region. The positive column region is an emitting region in which plasma discharge is actively generated by a very small voltage. Accordingly, it is important to enlarge the positive column region in order to increase the efficiency of a plasma display panel. Since a length of the sheath region is not related to a discharge gap, the positive column region is enlarged to extend a discharge length. However, when the discharge gap is enlarged to extend the discharge length, it may generate an increase in the required discharge firing voltage.

As such, a low discharge firing voltage and high efficiency cannot be achieved simultaneously in the conventional plasma display panel.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a plasma display panel having an advantage of reducing a discharge firing voltage by firing a discharge in an opposed discharge mechanism. The discharge firing voltage further is reduced by firing the discharge with a short discharge gap, and efficiency is enhanced by increasing a discharge gap of a main discharge.

In a plasma display panel according to an embodiment of the present invention, a first substrate and a second substrate are disposed to face each other and a space therebetween is divided into at least one discharge cell. A phosphor layer is formed in the discharge cell. An address electrode is formed on the first substrate in a first direction, and a first electrode and a second electrode are formed on the first substrate in a second direction crossing the first direction. The first electrode and the second electrode are electrically isolated from the address electrode and correspond to the discharge cell to face each other with a space therebetween. A shape of the first electrode is different from a shape of the second electrode.

The first electrode has a first portion that corresponds to a discharge space of the discharge cell, and a second portion that is connected to the first portion and formed along the second direction. And, a length in the second direction of a portion of the first portion near the first substrate is different from a length in the second direction of another portion of the first portion near the second substrate.

The length in the second direction of the portion of the first portion near the first substrate is longer or shorter than the length in the second direction of the portion of the first portion near the second substrate.

The portion of the first portion near the first substrate protrudes inside the discharge cell more than the portion of the first portion near the second substrate.

The first portion includes electrode layers having different lengths in at least one of the first direction and the second direction.

The electrode layers become longer or shorter stepwise toward the first substrate in the second direction. And the electrode layers protrude more inside the discharge cell stepwise toward the first substrate.

An electrode layer of the electrode layers near the first substrate is wider than another electrode layer of the electrode layers near the second substrate.

The second electrode may have a third portion that corresponds to the discharge space of the discharge cell, and a fourth portion that is connected to the third and formed along the second direction. Selectively the second electrode may have a stripe shape.

Here, a portion of the second electrode to correspond the discharge space of the discharge cell has a uniform length of the first direction and has a uniform length of a third direction perpendicular to the first substrate.

According to such an exemplary plasma display panel, the first electrode and the second electrode are formed facing each other in each discharge cell, and therefore an opposed discharge is realized for a sustain discharge, thereby enabling reduction of the discharge firing voltage. In addition, since both a short gap and a long gap are formed between the first electrode and the second electrode, a discharge firing voltage may be further reduced due to a short gap discharge, while discharge efficiency is enhanced due to a long gap discharge.

And, the first electrode and the second electrode are different shapes considering discharge stability and discharge efficiency, thereby simultaneously enhancing several properties of a plasma display panel.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE EMBODIMENTS

An embodiment of the present invention will hereinafter be described in detail with reference to the accompanying drawings.

Figure 1:
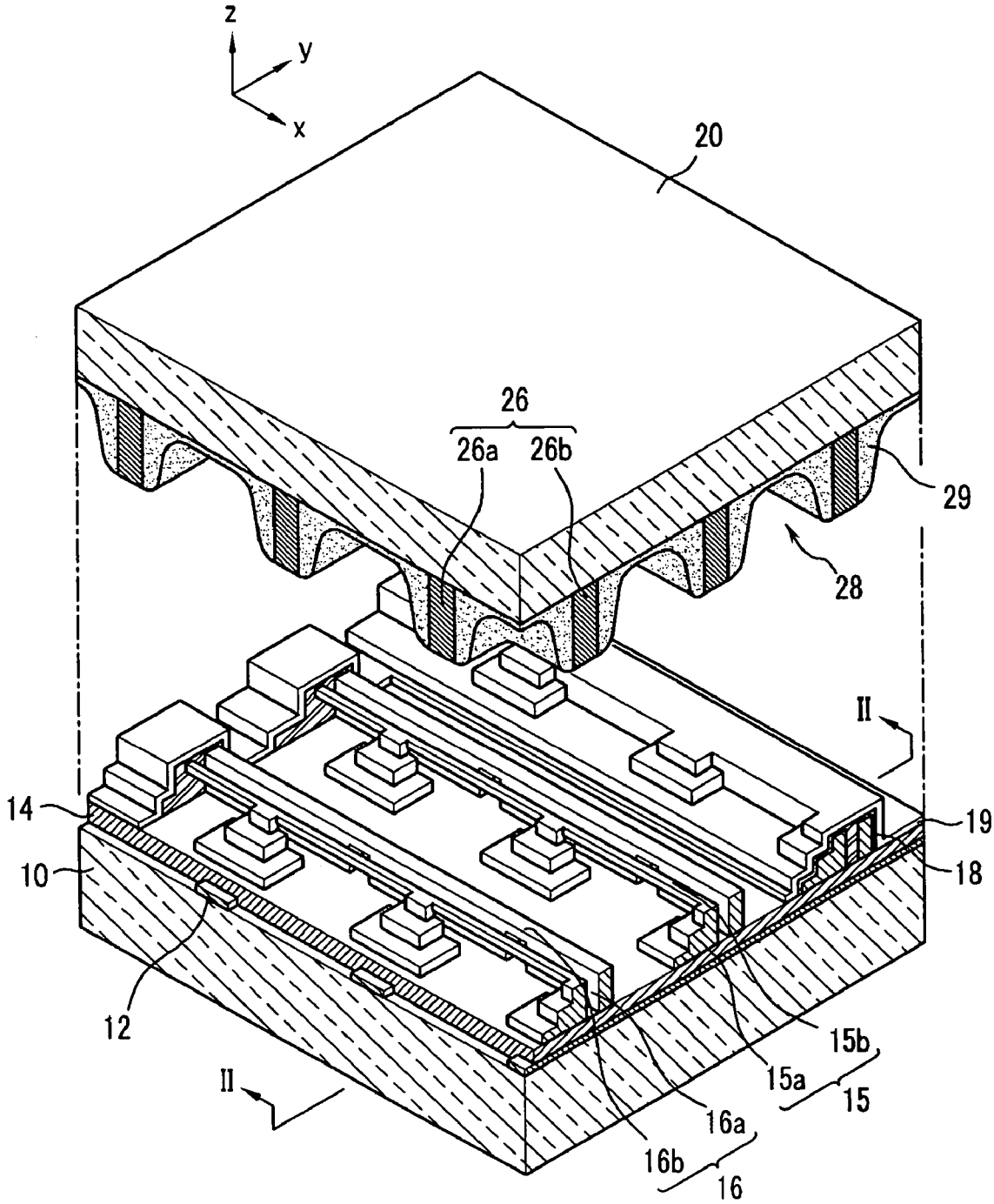
FIG. 1 is a partial exploded perspective view illustrating a plasma display panel according to a first embodiment of the present invention.
Figure 2:
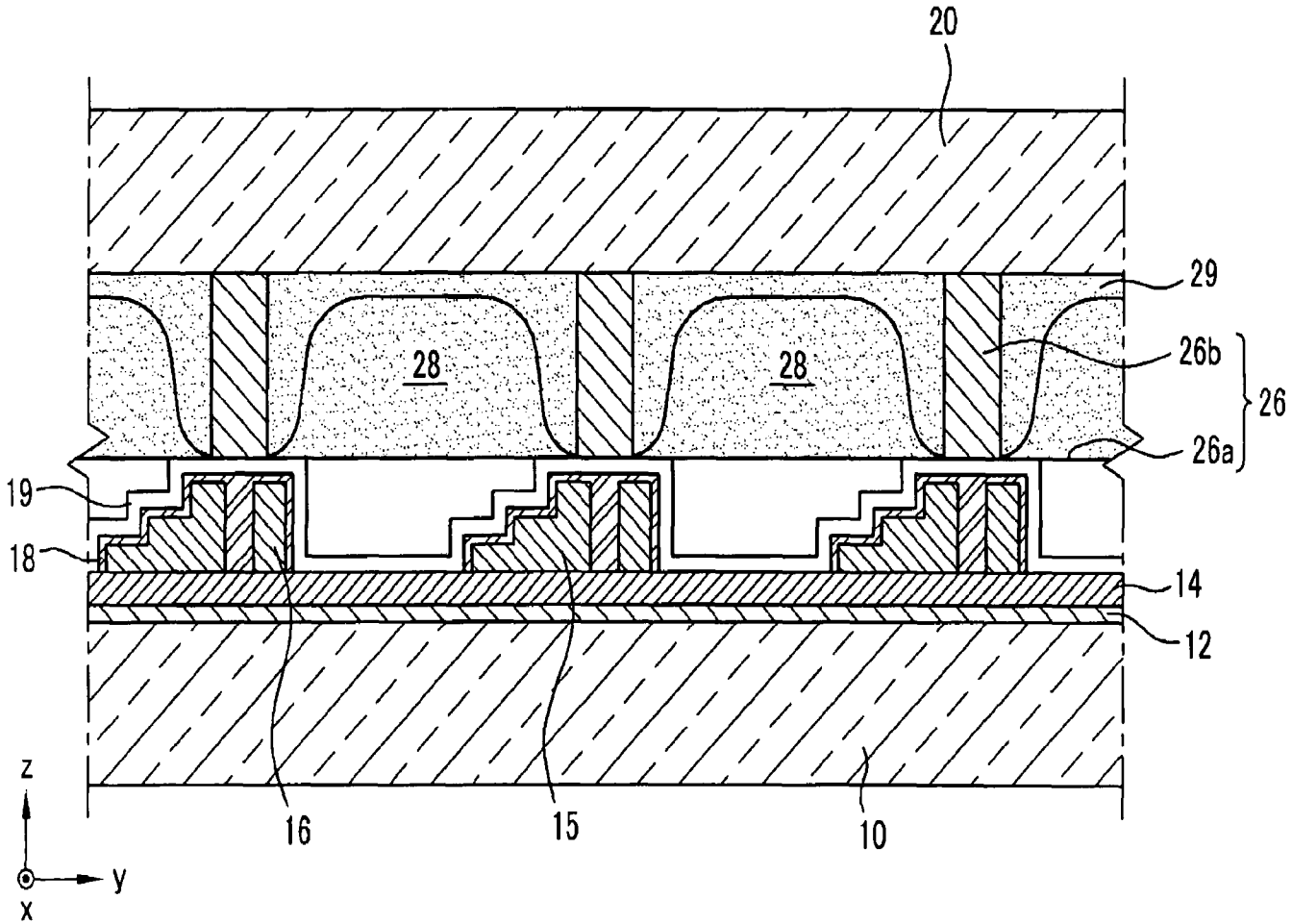
FIG. 2 is a partial cross-sectional view taken along the line H-H of FIG. 1.
Figure 3:
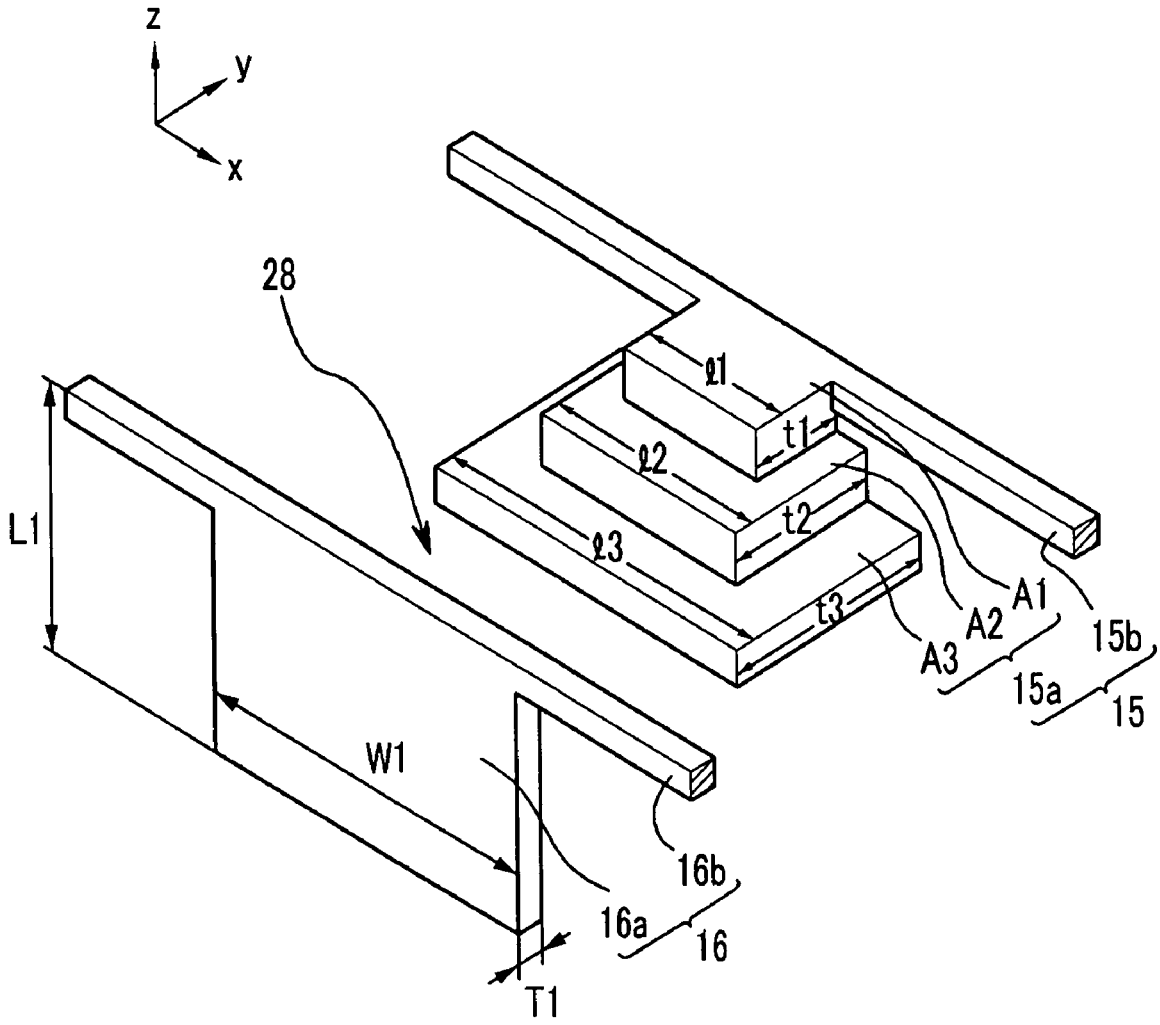
FIG. 3 is a partial perspective view illustrating a first electrode and a second electrode that correspond to a discharge cell in the plasma display panel according to the first embodiment of the present invention.
Figure 4:
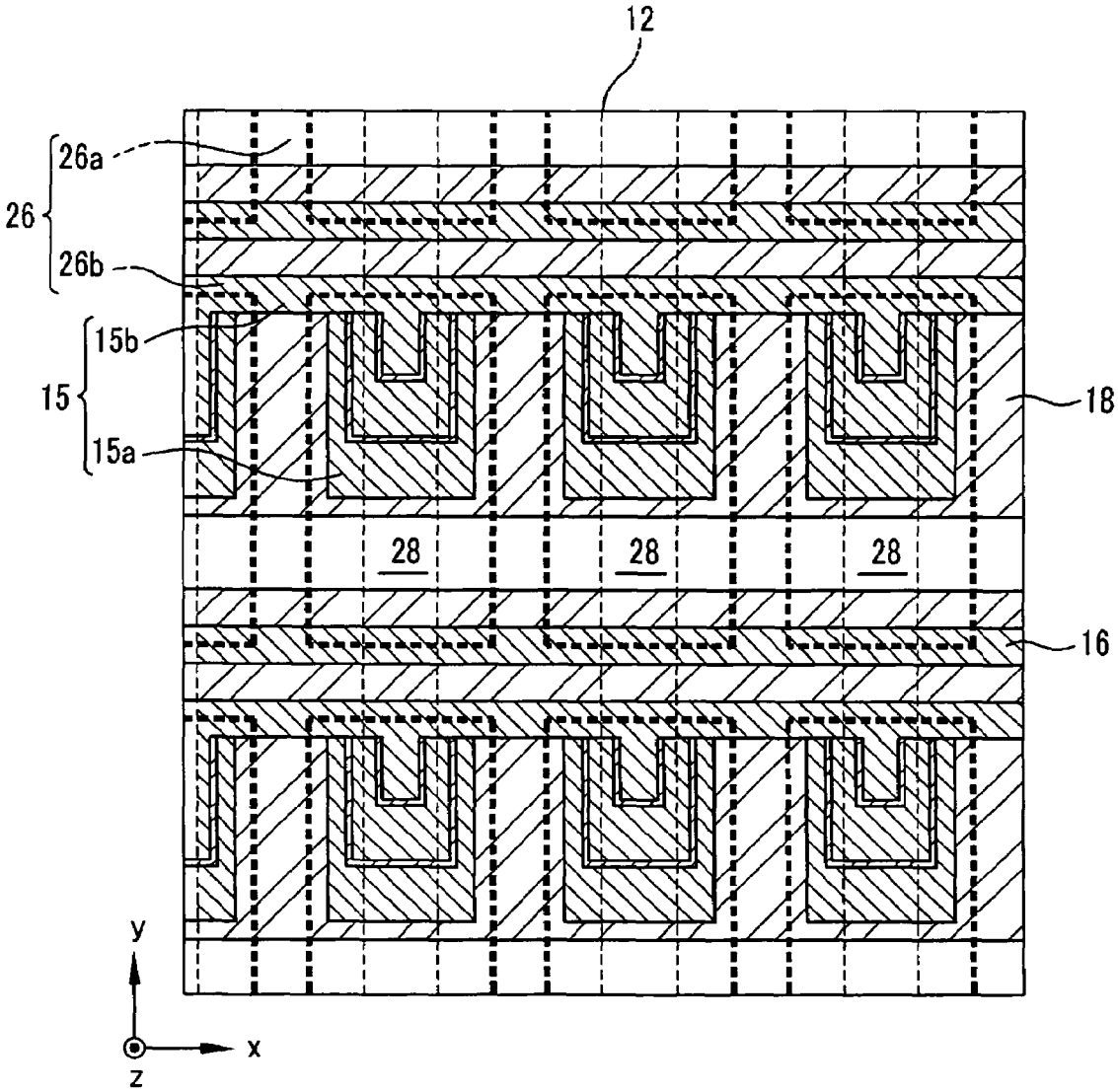
FIG. 4 is a partial top plan view illustrating the plasma display panel according to the first embodiment of the present invention.

According to a first embodiment of the invention, FIG. 1 is a partial exploded perspective view illustrating a plasma display panel. FIG. 2 is a partial cross-sectional view taken along the line II-II of FIG. 1. FIG. 3 is a partial perspective view illustrating a first electrode and a second electrode that correspond to a discharge cell in the plasma display panel. FIG. 4 is a partial plan view illustrating the plasma display panel.

Referring to FIG. 1 and FIG. 2, in the plasma display panel, a rear substrate 10 and a front substrate 20, each having a predetermined size, are disposed substantially in parallel with each other with a predetermined gap between them. A space between the rear substrate 10 and the front substrate 20 is divided into a plurality of discharge cells 28 by barrier ribs (rib barriers) 26.

The barrier ribs 26 are formed on a surface of the front substrate 20 opposite the rear substrate 10 to define the discharge cells 28. The barrier ribs 26 include a first barrier rib members **26*a* that are formed along a first direction (in the drawing, a y-axis direction) and a second barrier rib members 26*b*** that are formed along a second direction (in the drawing, an x-axis direction) to cross the first direction.

The barrier rib structure of the present invention is not limited to the above-described structure. A stripe-shaped barrier rib structure, which includes only barrier rib members formed along the first direction, can be applied to the present invention. In another embodiment, various other types of barrier rib structures for dividing and defining the discharge cells can be applied to the present invention.

In the present invention, a dielectric layer (not shown) may be formed on the front substrate 20 and then the barrier ribs 26 may be formed on the dielectric layer. This configuration also falls within the scope of the embodiments of present invention.

Red, blue, and green phosphor layers 29, which absorb ultraviolet rays and in response emit visible light, are formed in the discharge cells 28. A discharge gas (for example, mixed gas of xenon (Xe), neon (Ne) and other gases) is filled into the respective discharge cells 28 to be used to create a plasma discharge. In the present embodiment, in each discharge cell 28, the phosphor layer 29 is formed on the side surfaces of the barrier ribs 26 and the bottom surface of the front substrate 20 between the barrier ribs 26.

Address electrodes 12 are formed along the first direction on a surface of the rear substrate 10 opposite the front substrate 20. A first dielectric layer 14 is formed on the entire surface of the rear substrate 10 to cover the address electrodes 12. In the present embodiment, the address electrodes 12 have stripe shapes with uniform line widths.

On the first dielectric layer 14, first electrodes 15 and second electrodes 16 are formed along the second direction and are electrically isolated from the address electrodes 12 by the first dielectric layer 14. In the present embodiment, the first electrodes 15 and the second electrodes 16 correspond to discharge cells 28. In a pair of adjacent discharge cells 28 along a first direction, the first electrodes 15 and the second electrodes 16 are disposed in an alternating order. For example, a first electrode 15 may be followed by a second electrode 16, then a first electrode 15, and finally a second electrode 16. Selectively, the order may be a first electrode, a second electrode, another second electrode, and then another first electrode.

The first electrodes 15 are involved in an address discharge during an address period, together with the corresponding address electrodes 12. The second electrodes 16 are involved in a sustain discharge during a sustain period together with the corresponding first electrodes 15. That is, the first electrodes 15 function as scan electrodes and the second electrodes 16 function as sustain electrodes. The electrodes are not limited to the above-described functions and may perform functions different from the above-described functions depending on a signal voltage applied. Therefore the first electrodes function as sustain electrodes and the second electrodes function as scan electrodes in another embodiment.

The first electrode 15 includes first portions 15*a* that correspond to each discharge space of each discharge cell 28, and second portions 15*b* that connect adjacent ones of the first portions 15*a* along the second direction. The second electrode 16 includes third portions 16*a* that correspond to each discharge space of each discharge cell 28, and fourth portions 16*b* that connect adjacent ones of the third portions 16*a* along the second direction.

The first portion 15*a* of the first electrode 15 and the third portion 16*a* of the second electrode 16 face each other with a space there between in each discharge cell 28. The first electrode 15 and the second electrode 16 are formed to face each other in each discharge cell 28, and thus the sustain discharge between the first electrode 15 and the second electrode 16 can be induced by an opposed discharge. Therefore, as compared to the conventional plasma display panel in which the sustain discharge is induced by a surface discharge, the discharge firing voltage of the sustain discharge can be reduced.

In the present embodiment, the first electrode 15 and the second electrode 16 have different shapes. Hereinafter, it will be described in more detail.

A portion of each of the first portions 15*a* of the first electrodes 15 nearest the rear substrate 10 protrudes more inside each discharge cell 28 than another portion of each of the first portions 15*a* of the first electrodes 15 nearer the front substrate 20. That is, a length in the first direction of the portion of the first portion 15*a* of the first electrode 15 nearest the rear substrate 10 is longer than a length of the portion of the first portion 15*a* of the first electrode 15 nearer the front substrate 20.

Further, a length of the portion of the first portion 15*a* nearest the rear substrate 10 is longer in the second direction than that of the portion of the first portion 15*a* nearer the front substrate 20. Accordingly, first portions 15*a* have a stepwise formation in both the first and second directions.

To this, as shown in FIG. 3, the first portion 15*a* is made of a laminate including at least two electrode layers A1, A2 and A3, which each have different lengths in the first direction and the second direction in the present embodiment. The respective electrode layers A1, A2, and A3 are formed to physical contact with each other to be electrically connected to each other. In the present embodiment, the second portion 15*b* respectively connects adjacent ones of the electrode layers A1, which are disposed nearest to the front substrate 20.

Although, as shown in FIG. 3, the first portion 15*a* include the electrode layer A1 which is close to the front substrate 20, the electrode layer A3 which is disposed close to the rear substrate and the electrode layer A2 which is disposed between the electrode layer A1 and the electrode layer A3, the embodiments of the present invention are not limited to this configuration. The embodiments of the present invention may be varied to include all permutations of the use of at least two electrode layers in the first portion.

The electrode layers A1, A2, and A3 in the first portion 15*a* of the first electrode 15 are further described below.

The first portion 15*a* of the first electrode 15 may be structured so that t2 is larger than t1 and t3 is larger than t2. Here, t1, t2, and t3 are lengths of the electrode layer A1, the electrode layer A2, and the electrode layer A3 of the first portion 15*a* of the first electrode 15 in the first direction (e.g., the y-axis), respectively.

The length of the first portion 15*a* of the first electrode 15 in the first direction increases in a stepwise or incremental fashion from the electrode layer A1 which is close to the front substrate to the electrode layer A3 which is close to the rear substrate 10. Therefore, the cross-section of the first portion 15*a* which is perpendicular to the second direction is a step shape in which the length increases stepwise from the electrode layer A1 which is close to the front substrate 20 to the electrode layer A3 which is close to the rear substrate 10.

Further, the first portion 15*a* of the first electrode 15 may be structured so that l2 is larger than l1 and l3 is larger than l2. Here, l1, l2, and l3 are lengths of the electrode layer A1, the electrode layer A2, and the electrode layer A3 of the first portion 15*a* of the first electrode 15 in the second direction (e.g., the x-axis), respectively.

The length of the first portion 15*a* of the first electrode 15 in the second direction increases in a stepwise or incremental fashion from the electrode layers A1 which is close to the front substrate 20, to the electrode layer A3 which is close to the rear substrate 10. Therefore, the cross-section of the first portion 15*a* which is perpendicular to the first direction is a step shape in which the length increases stepwise from the electrode layer A1 which is close to the front substrate 20 to the electrode layer A3 which is close to the rear substrate 10.

Accordingly, the sections of the first portion 15*a* of the first electrode 15 which is parallel to the first substrate 10 are formed to be progressively wider from the electrode layers A1 to the electrode layers A3.

The first electrode 15 has this shape can be easily manufactured by a printing method or similar methods.

In the present invention, the first portion of the first electrode may have a different number of electrode layers. These alternative embodiments also fall within the scope of the present invention.

The second electrode 16 is as follows. The third portion 16*a* of the second electrode 16 has a uniform length T1 in the first direction (e.g., the y-axis) from a portion near the rear substrate 10 to a portion near the front substrate 20. Similarly, the third portion 16*a* of the second electrode 16 has a uniform length W1 in the second direction (e.g., the x-axis) from the portion near the rear substrate 10 to the portion near the front substrate 20.

A length L1 of the third portion 16*a* in the third direction (in the drawing, a z-axis direction) perpendicular to the rear substrate 10 is longer than the length T1 of the third portion 16*a* in the first direction. And the length W1 of the third portion 16*a* in the second direction has enough length to correspond a discharge space of the discharge cell. Accordingly, the sustain discharge is stably induced by the opposed discharge since the area is large which the first portion 15*a* of the first electrode 15 is opposite to the third portion 16*a* of the second electrode 16.

Second dielectric layers 18 are formed to surround the first electrode 15 and second electrode 16. Referring to FIGS. 1, 2 and 4, in the present embodiment, the second dielectric layers 18 are formed to extend along the second direction while surrounding the first electrode 15 and the second electrode 16, such that the discharge space is formed between the first electrode 15 and the second electrodes 16. Because the first electrode 15 and second electrodes 16 are divided up and assigned to corresponding discharge cells 28, erroneous discharge is not caused.

For clear understanding, in FIG. 4, the respective electrode layers A1, A2, and A3 of the first electrodes 15, the second electrodes 16 and the second dielectric layers 18 are shown by the cross-sections that are parallel to the substrate 10. This is applied to plan views described below.

Returning to FIG. 1, a Magnesium Oxide (MgO) protective film 19 is formed on the entire surface of the rear substrate 10 to cover the first dielectric layer 14 and the second dielectric layer 18. The MgO protective film 19 prevents the first dielectric layer 14 and the second dielectric layer 18 from being damaged due to the collision of ions that are created at the time of the plasma discharge. The MgO protective film 19 has high secondary electron emission coefficient, and thus, the MgO protective film 19 increases the discharge efficiency.

As described above, in the present embodiment, all the address electrodes 12, the first electrodes 15 and the second electrodes 16 involved in the discharge are formed on the rear substrate 10.

Because the address electrodes 12 and the first electrodes 15 involved in the address discharge are formed on the rear substrate 10, the path of the address discharge can be reduced and thus the discharge firing voltage of the address discharge can be reduced. In addition, because the phosphor layers 29 are formed on the front substrate 20, inconsistency in the discharge firing voltage due to the phosphor layers 29 of different colors having different dielectric constants can be prevented.

Because none of the electrodes 12, 15, and 16 involved in the discharge are disposed on the front substrate 20, the transmittance of visible light generated by the plasma discharge can be enhanced. Further, because the first electrodes 15 and second electrodes 16 are made of only metal electrodes having superior conductivity, the manufacturing processes can be simplified and the manufacturing cost can be reduced, in comparison of the conventional plasma display panel that has transparent electrodes and metal electrodes.

Figure 5:
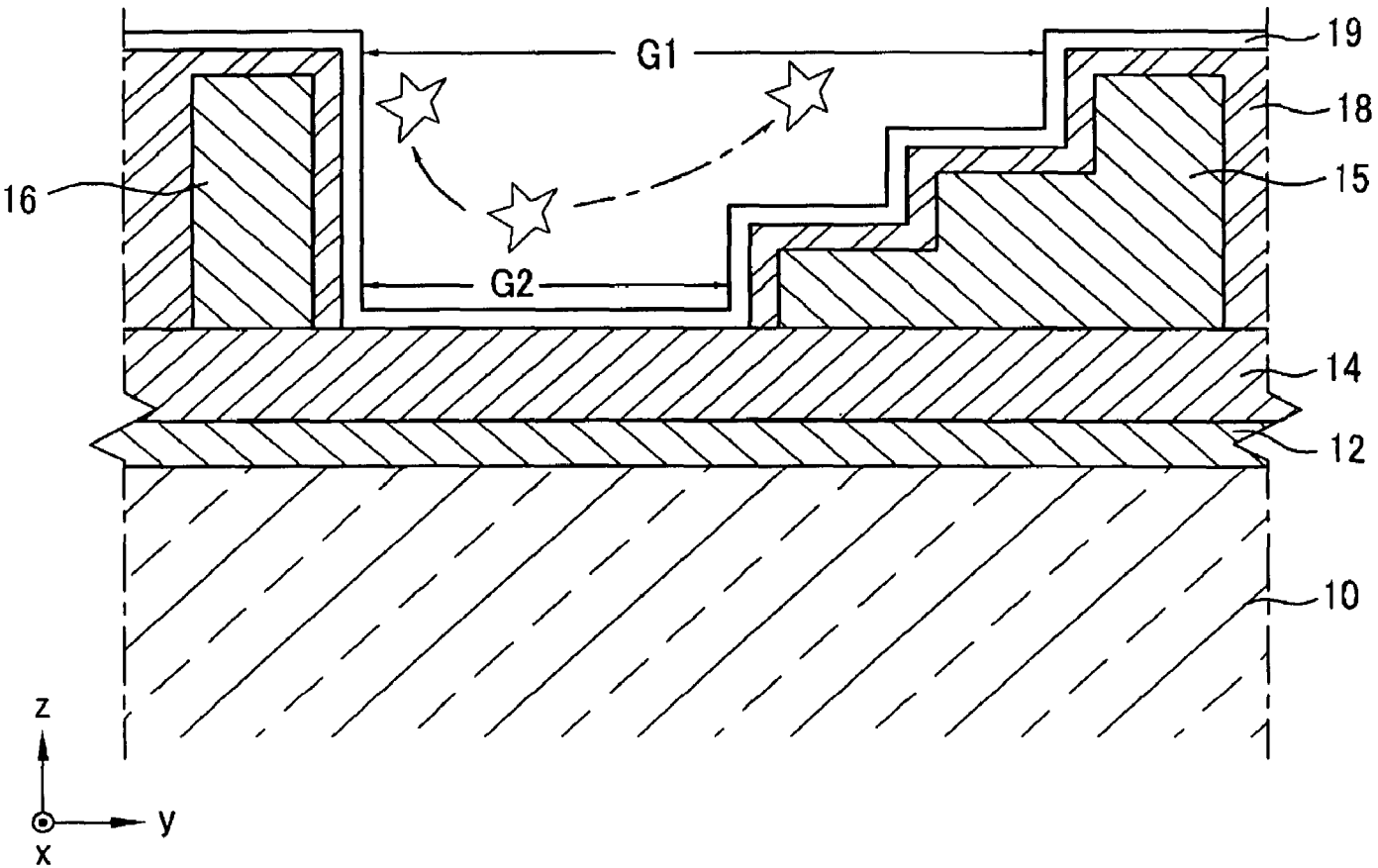
FIG. 5 is a cross-sectional view illustrating a rear plate of the plasma display panel according to the first embodiment of the invention.

The discharge of such a plasma display panel will be described with reference to FIG. 5 together FIG. 1. FIG. 5 is a cross-sectional view illustrating a rear plate of the plasma display panel according to the first embodiment of the invention. The rear plate refers to the rear substrate 10 on which the address electrodes 12, the first and second electrodes 15 and 16 and so on are formed.

In the present embodiment, the first portions 15*a* of the first electrodes 15 protrude further inside the discharge cell 28 near the rear substrate 10 than near the front substrate 20. Therefore, a short gap G2 is formed between the first electrode 15 and the second electrode 16 near the rear substrate 10 and a long gap G1 is formed between the two electrodes 15 and 16 near the front substrate 20. As a result, as shown in FIG. 5, the discharge is fired across the short gap G2 nearest the rear substrate 10 and is diffused across the long gap G1 nearer the front substrate 20.

In the present embodiment, because the discharge is fired across the short gap G2 nearest the rear substrate 10, the discharge firing voltage can be reduced. Generally, the larger the area of the electrode is, the lower the discharge firing voltage is. In the present embodiment, the first electrodes 15 are formed so that the electrode layers thereof become larger toward the rear substrate 10. As a result, the discharge firing voltage can be further reduced.

Because a main discharge is created between the electrode layers near the front substrate 20 having the long gap, the discharge length can be increased and thus the discharge efficiency can be enhanced. Generally, the larger the area the electrode has, the greater the amount of current that flows in the electrode is. Therefore, as the area of the electrode layers of the first electrodes 15 near the front substrate 20 that are not involved in firing the discharge is decreased, the amount of discharge current can be limited.

Further, the second electrodes 16 have different shapes from the first electrode 15 in the present invention. Here, the third portion 16*a* of the second electrodes 16 have uniform lengths, and thus discharge stability of the sustain discharge between the first electrodes and the second electrodes improves.

That is, the first electrode 15 and the second electrode 16 are different shapes considering the discharge efficiency and stability, thereby simultaneously enhancing several properties of a plasma display panel.

Hereinafter, modifications of the first embodiment of the present invention will be described. The modifications of the first embodiment are based on the same basic configuration as that of the first embodiment and include many of the same or similar parts as the first embodiment, which are represented by the same reference numerals in the accompanying drawings.

Figure 6:
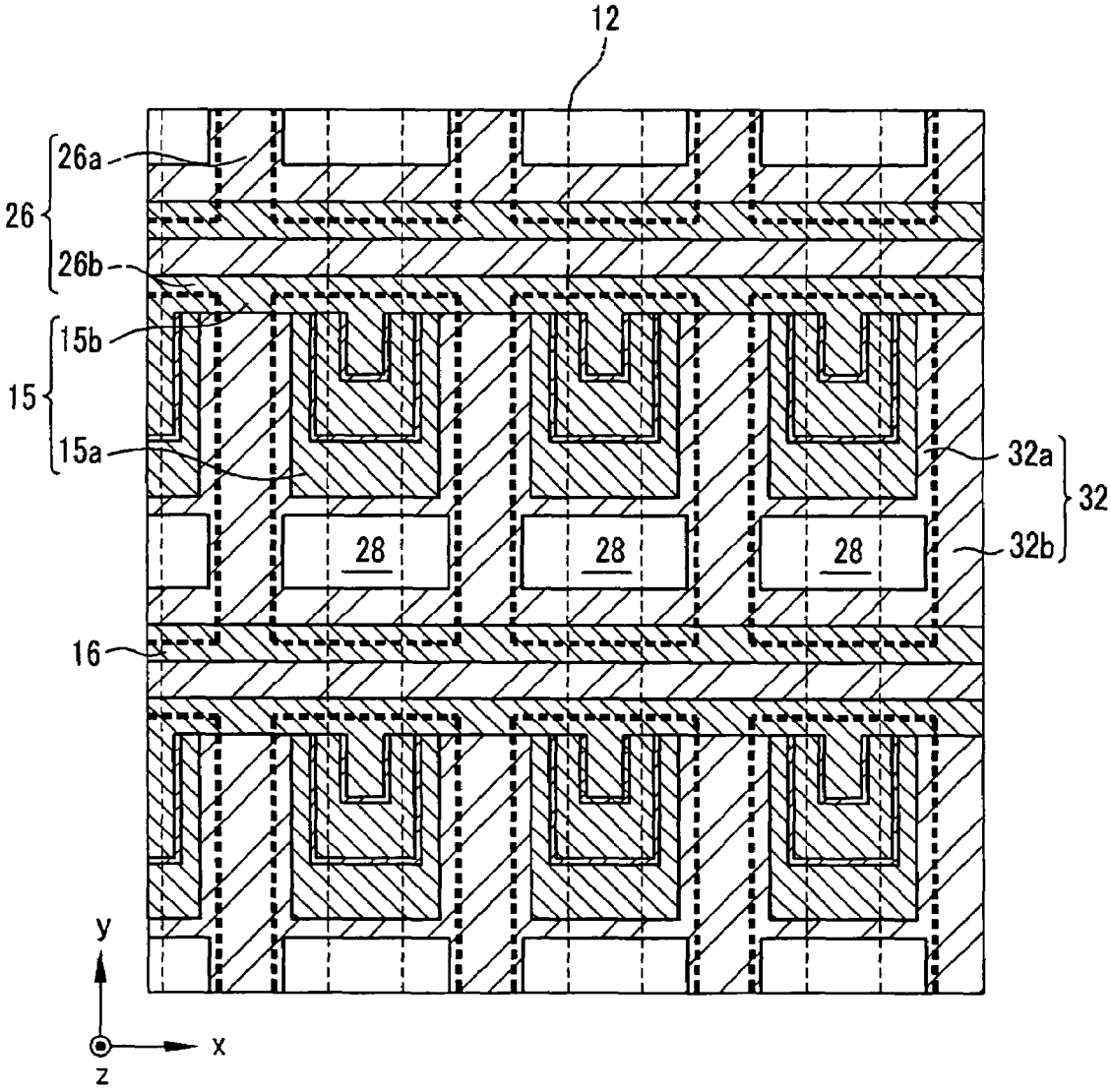
FIG. 6 is a partial plan view illustrating a plasma display panel according to a first modification of the first embodiment of the present invention.

FIG. 6 is a partial plan view illustrating a plasma display panel according to a first modification of the first embodiment of the present invention.

Referring to FIG. 6, in the first modification, a second dielectric layer 32 includes a first dielectric layer portion 32*a* that is formed along the second direction (e.g., the x-axis direction) to surround the first electrode 15 or the second electrode 16, and a second dielectric layer portion 32*b* that is formed along the first direction (e.g., the y-axis direction). The second dielectric layer portion 32*b* is formed along the lines corresponding to the first barrier rib members 26*a*.

In the first modification, because the second dielectric layer 32 includes the second dielectric layer portion 32*b*, the discharge cells 28 can be separated from one another with greater independence. Accordingly, the discharge of the respective discharge cells 28 can be controlled more accurately.

Figure 7:
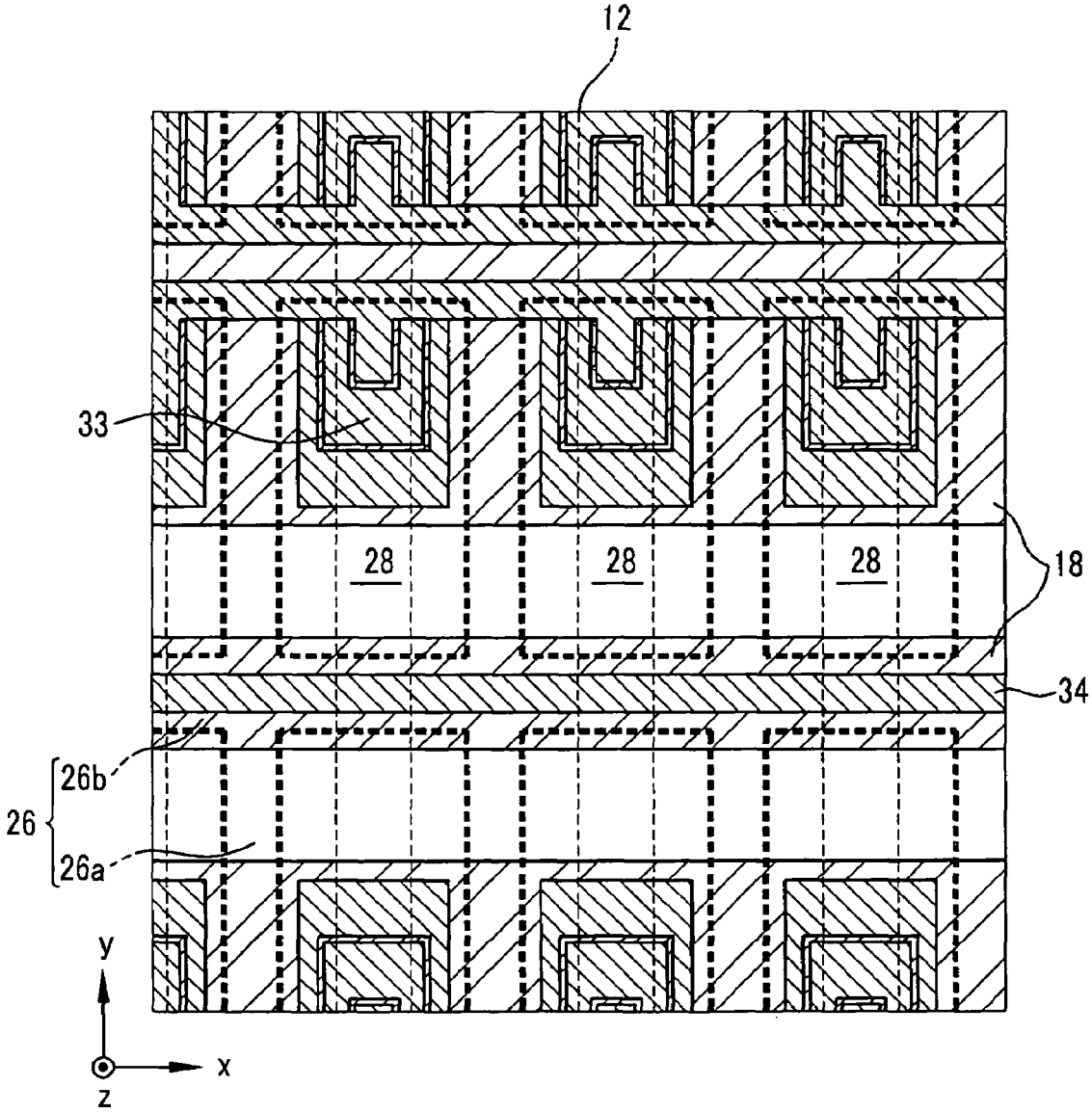
FIG. 7 is a partial plan view illustrating a plasma display panel according to a second modification of the first embodiment of the present invention.

FIG. 7 is a partial plan view illustrating a plasma display panel according to a second modification of the first embodiment of the present invention.

As shown in FIG. 7, in the second modification, a second electrode 34 is formed to be X shared by a pair of adjacent discharge cells 28 in the first direction (e.g., the y-axis direction). Thus, the arrangement of electrodes may be a first electrode 33, then a second electrode 34, and a first electrode 33 is formed in a pair of adjacent discharge cells 28 in the first direction (e.g., the y-axis direction). This arrangement may be sequentially repeated in the first direction. In a plasma display panel according to the second modification, for example, the address discharge is caused by applying a voltage to the first electrode 33 and the address electrode 12 and the sustain discharge is caused by applying a voltage to the first electrode 33 and the second electrode 34. The electrodes are not limited to the above-described functions and may perform functions different from the above-described functions depending on a signal voltage applied.

The arrangement of the electrodes of the present invention is not limited to the above-described structure. Selectively, a second electrode may be separately formed to correspond each of discharge cells in the first direction, and a first electrode may be formed to be shared by a pair of adjacent discharge cells in the first direction. Further, a first electrode and a second electrode may be formed to be shared by a pair of adjacent discharge cells in the first direction. That is, various other types of arrangement of electrodes can be applied to the present invention.

Figure 8:
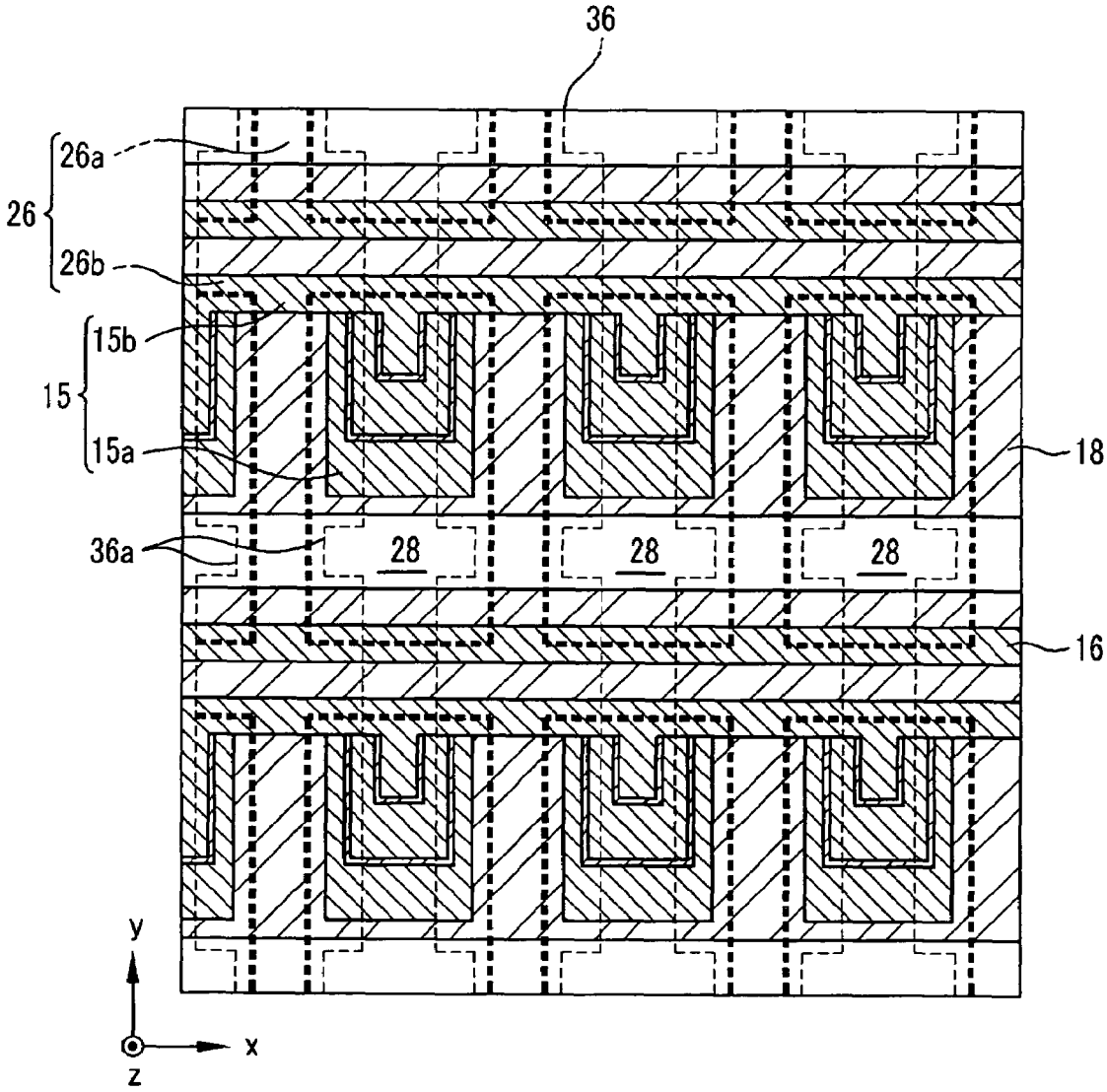
FIG. 8 is a partial plan view illustrating a plasma display panel according to a third modification of the first embodiment of the present invention.

FIG. 8 is a partial plan view illustrating a plasma display panel according to a third modification of the first embodiment of the present invention.

As shown in FIG. 8, in the third modification, a protruding portion 36*a* is formed in a portion of an address electrode 36 corresponding to a space between the first electrode 15 and the second electrode 16. The protruding portion 36*a* extends outward from both sides of the address electrode 36.

In the third modification, the area of a portion of the address electrode 36 below the first electrode 15 and the second electrode 16 is reduced and the area of the portion of the address electrode 36 corresponding to the space between the first electrode 15 and the second electrode 16 is enlarged. Accordingly, the portion of the address electrode 36 not involved in the address & discharge is minimized and the portion involved in the address discharge is enlarged, such that the efficiency of the address discharge is enhanced.

Figure 9:
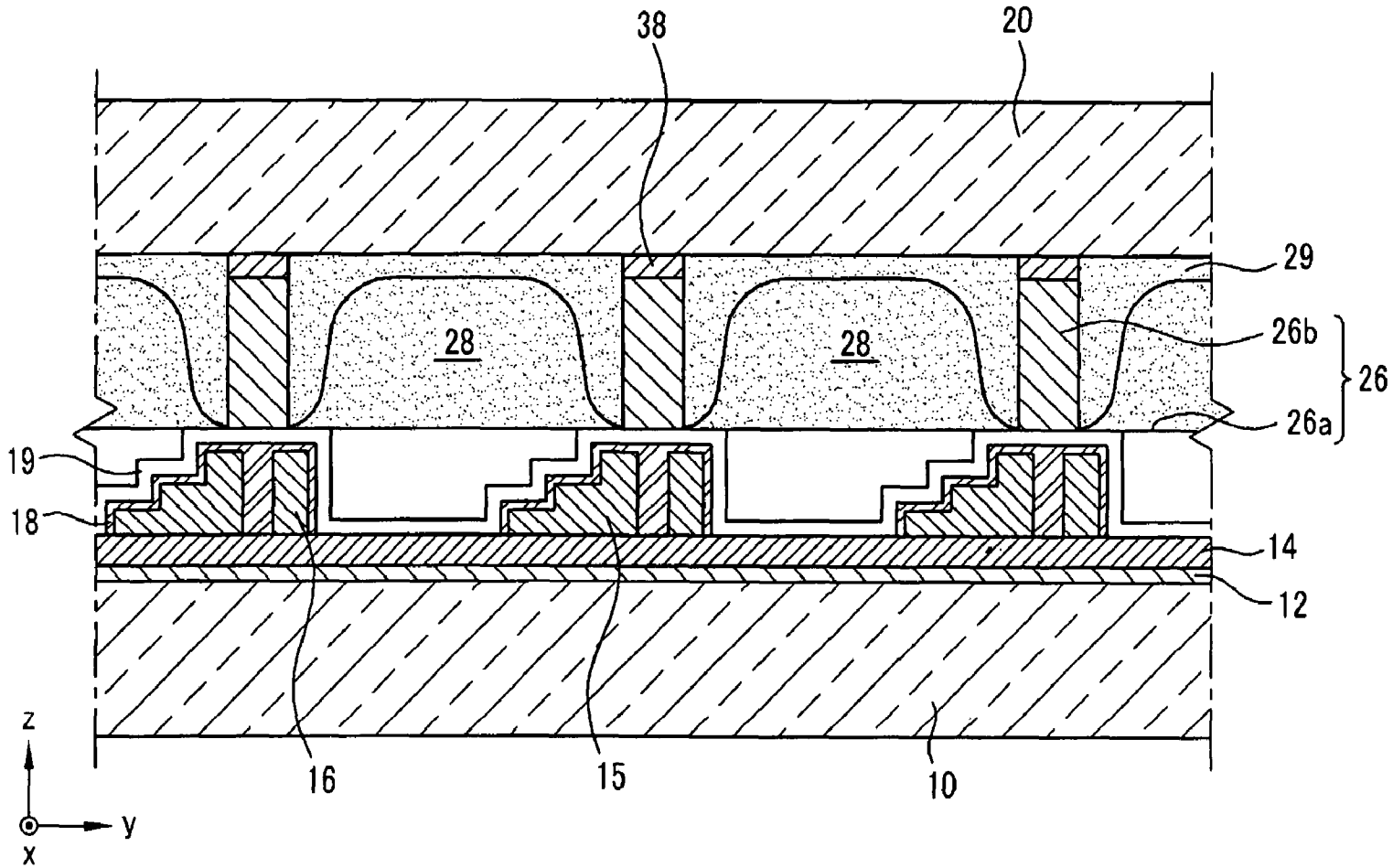
FIG. 9 is a cross-sectional view illustrating a plasma display panel according to a fourth modification of the first embodiment of the present invention.

FIG. 9 is a cross-sectional view illustrating a plasma display panel according to a fourth modification of the first embodiment of the present invention.

As shown in FIG. 9, in the fourth modification, a black layer 38 is formed between the front substrate 20 and the barrier rib 26. The black layer 38 prevents the reflectance of external light and the contrast of the plasma display panel is enhanced.

In an alternative embodiment, a dielectric layer is formed on the front substrate, and a black layer may be formed on the dielectric layer between the barrier rib and the dielectric layer. This configuration also falls within the scope of the embodiments of the present invention.

Figure 10:
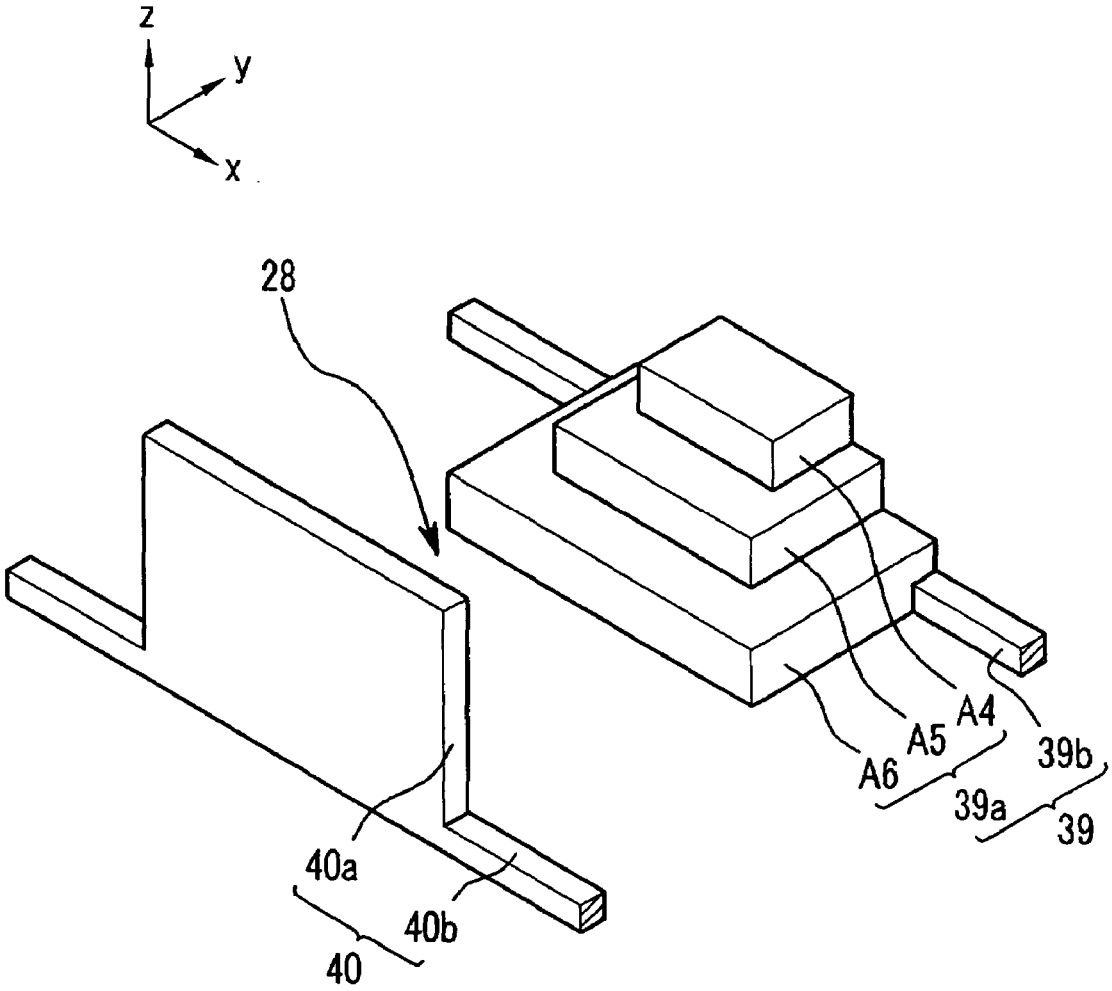
FIG. 10 is a partial perspective view illustrating a first electrode and a second electrode that correspond to a discharge cell in the plasma display panel according to a fifth modification of the first embodiment of the present invention.

FIG. 10 is a partial perspective view illustrating a first electrode and a second electrode that correspond to a discharge cell in the plasma display panel according to a fifth modification of the first embodiment of the present invention.

In the fifth modification, a first electrode 39 includes a first portion 39*a* that is formed to correspond to the respective discharge cells 28, and a second portion 39*b* that connect the first portions 39*a* in the second direction. A second electrode 40 includes a third portion 40*a* that is formed to correspond to the respective discharge cells, and a fourth portion 40*b* that connects the third portions 40*a* in the second direction. Here, the second portion 39*b* is formed to connect an electrode layer A6 of the first portion 39*a*, consisting of electrode layers A4, A5 and A6, near the rear substrate (not shown). The fourth portion 40*b* is also formed near the rear substrate (not shown).

The embodiments of the present invention are not limited to this configuration. Various & methods that the second portion connects the first portions and the fourth portion connects the third portions in the second direction can be applied to the present invention.

Figure 11:
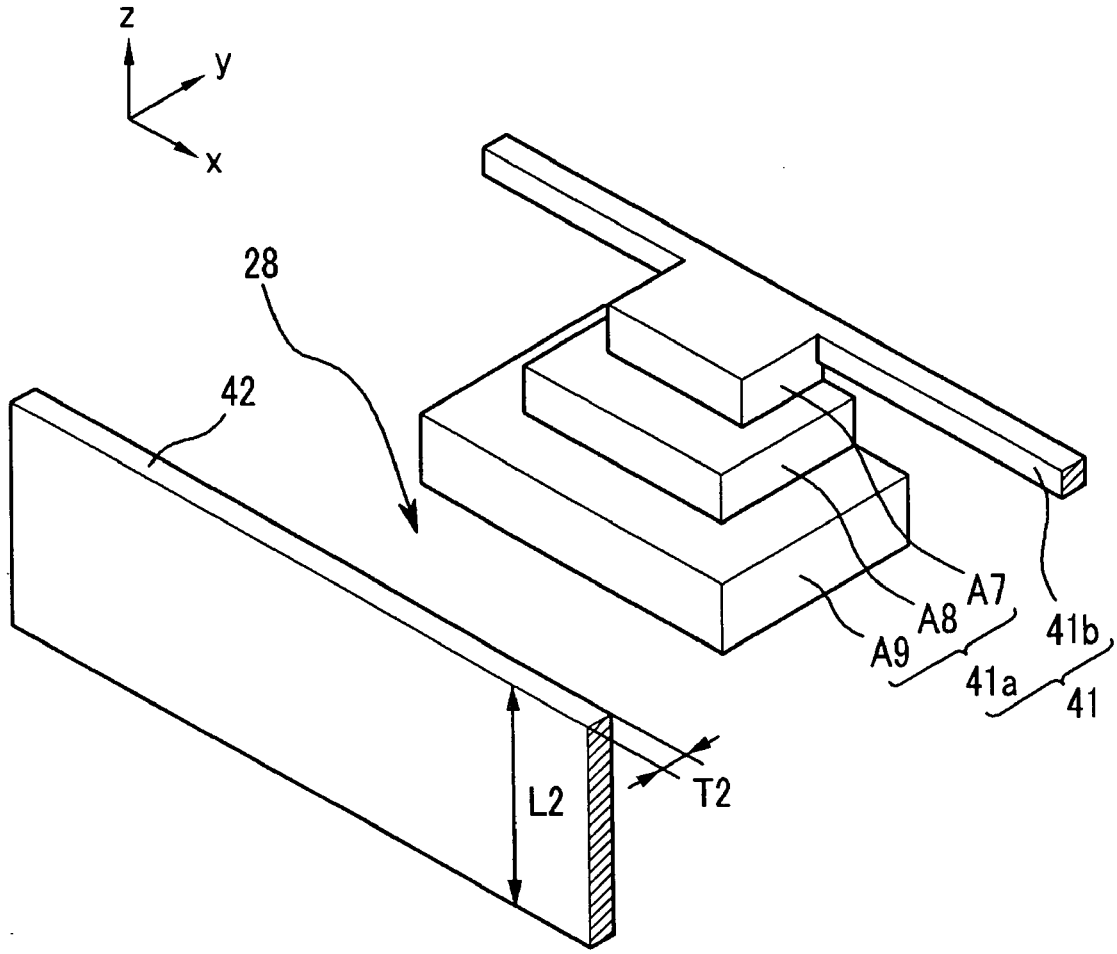
FIG. 11 is a partial perspective view illustrating a first electrode and a second electrode that correspond to a discharge cell in the plasma display panel according to a sixth modification of the first embodiment of the present invention.

FIG. 11 is a partial perspective view illustrating a first electrode and a second electrode that correspond to a discharge cell in the plasma display panel according to a sixth modification of the first embodiment of the present invention.

The first electrode 41 includes first portions 41*a* that correspond to each discharge space of each discharge cell 28, and second portions 41*b* that connect adjacent ones of the first portions 41*a* along the second direction (e.g., the x-axis direction).

The first portion 41*a* includes at least two electrode layers A7, A8 and A9, lengths of the first portion 41*a* in the first and second directions increase in a stepwise or incremental fashion from the electrode layer A7 which is close to the front substrate (not shown) to the electrode layer A9 which is close to the rear substrate (not shown).

And, referring to FIG. 11, the second electrode 42 has a stripe shape with uniform lengths T2 and L2 in the first direction (e.g., the y-axis direction) and in the third direction (e.g., the z-axis direction), respectively.

The length L2 of the second electrode in the third direction is longer than the length T2 in the first direction, and thus an opposed discharge generates stably between the first portion 41*a* of the first electrode 41 and the second electrodes 42.

The second electrode 42 has a different shape from the first electrode 41 in the sixth modification. The second electrode 42 has a stripe shape, thereby improving discharge stability of the sustain discharge between the first electrode and the second electrode 42. The shape of the second electrode of the present invention is not limited to the above-described shape. In another embodiment, various other shapes of second electrode can be applied to the present invention.

Hereinafter, a plasma display panel according to a second embodiment of the present invention will be described. The second embodiment of the present invention has the same configuration as that in the first embodiment, except that the shapes of the first and second electrodes are different. In the second embodiment, the parts matching those in the first embodiment are represented by the same reference numerals and the descriptions thereof are omitted.

Figure 12:
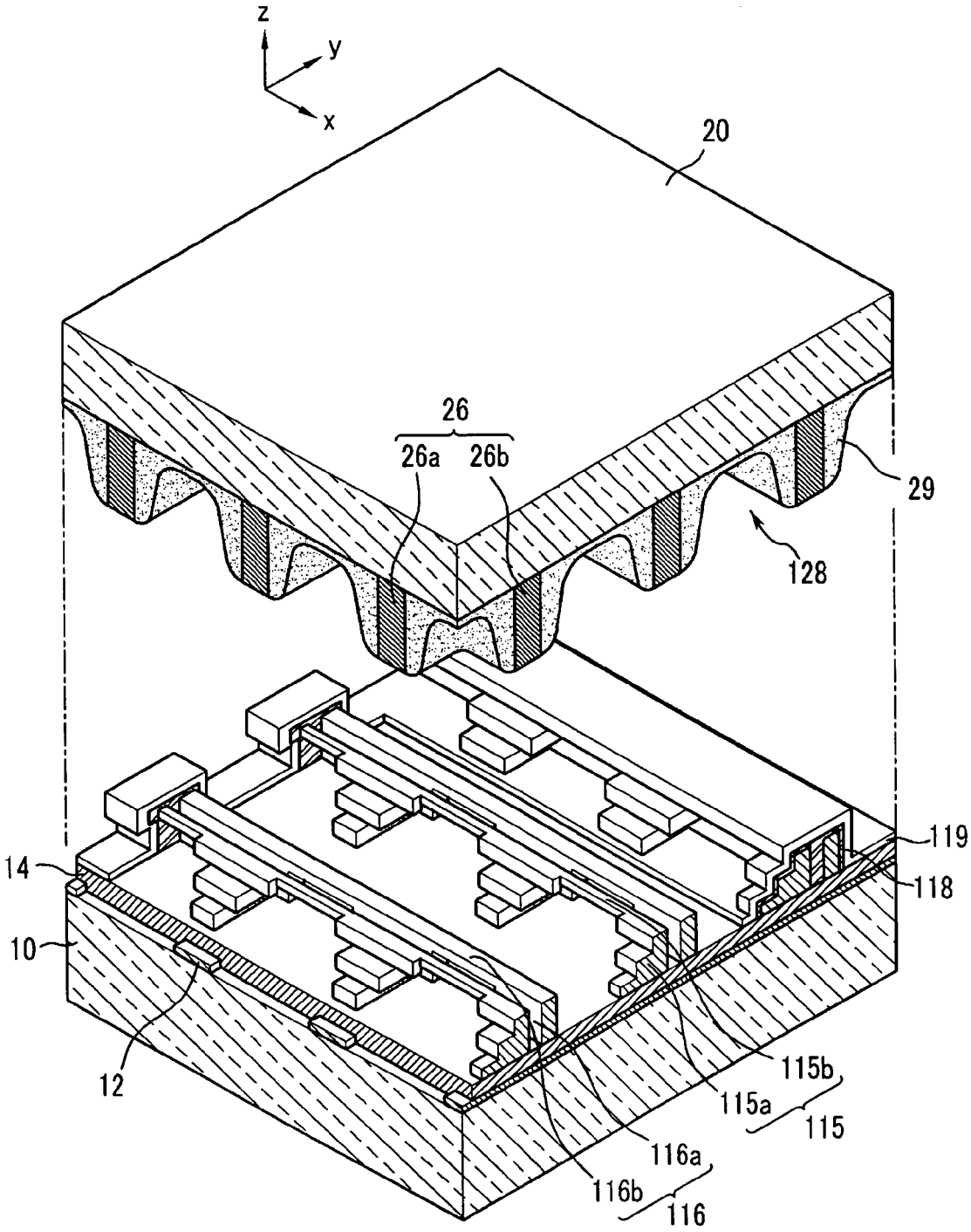
FIG. 12 is a partial exploded perspective view illustrating a plasma display panel according to a second embodiment of the present invention.
Figure 13:
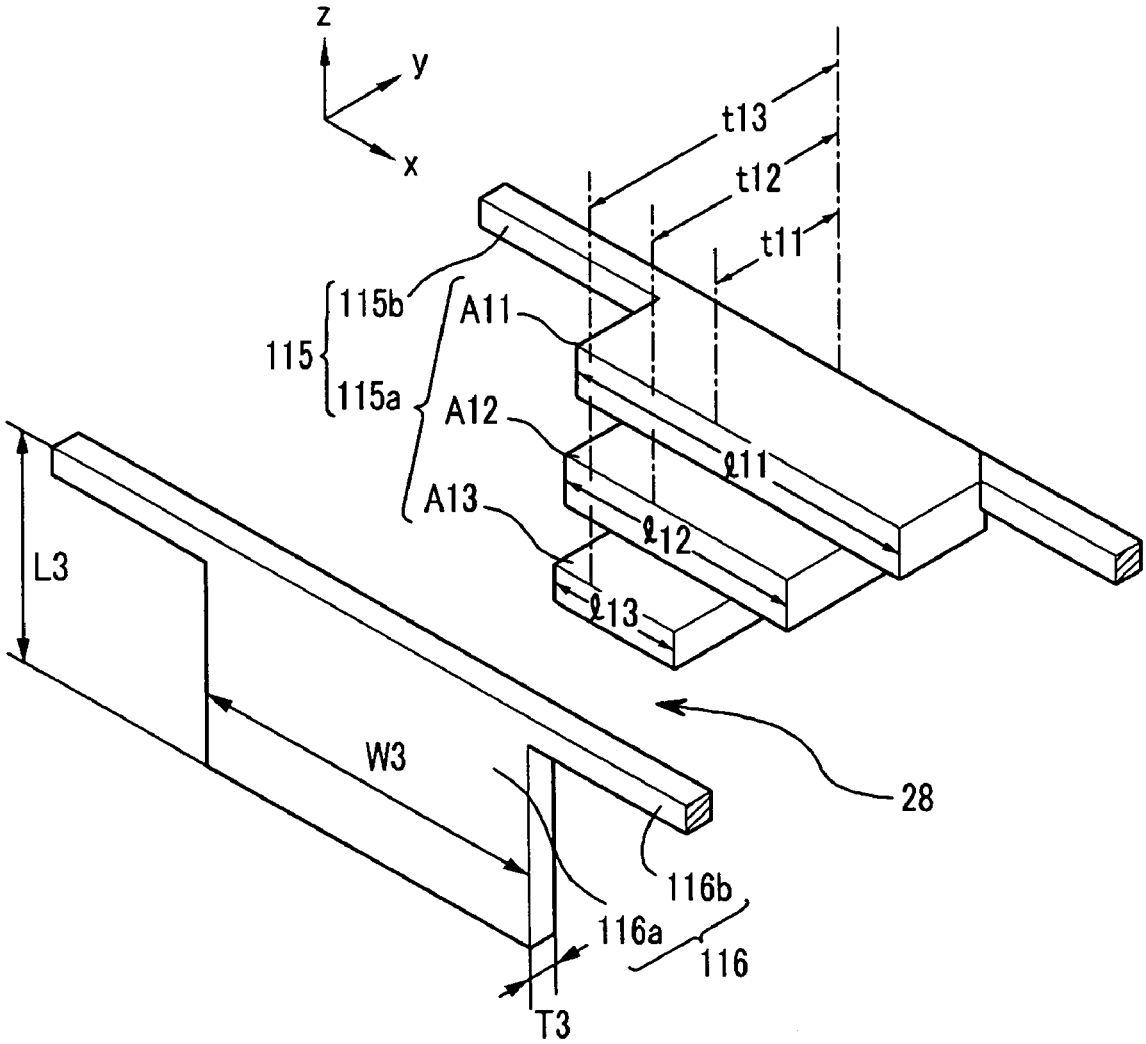
FIG. 13 is a partial perspective view illustrating a first electrode and a second electrode that correspond to a discharge cell in the plasma display panel according to the second embodiment of the present invention.
Figure 14:
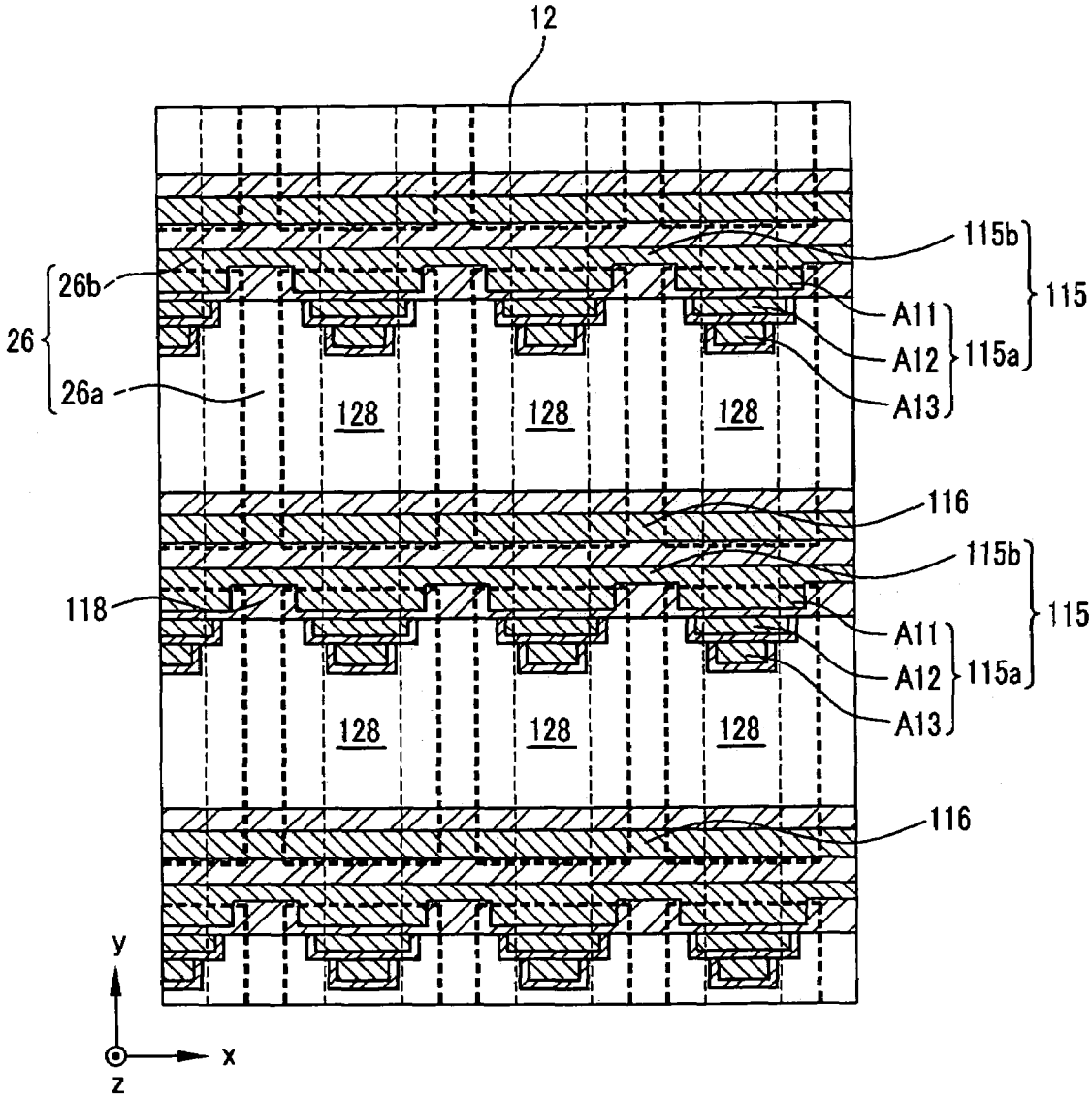
FIG. 14 is a partial plan view illustrating the plasma display panel according to the second embodiment of the present invention.

According to the second embodiment of the present invention, FIG. 12 is a partial exploded perspective view illustrating a plasma display panel. FIG. 13 is a partial perspective view illustrating a first electrode and a second electrode that correspond to a discharge cell in the plasma display panel. FIG. 14 is a partial plan view illustrating the plasma display panel.

Referring to FIG. 12, in the second embodiment, a first electrode 115 includes first portions 115*a* that correspond to each discharge space of each discharge cell 128, and second portions 115*b* that connect adjacent ones of the first portions 115*a* along the second direction (e.g., the y-axis direction). A second electrode 116 includes third portions 116*a* that correspond to each discharge space of each discharge cell 128, and fourth portions 116*b* that connect adjacent ones of the third portions 116*a* along the second direction. The first portion 115*a* of the first electrode 115 and the third portion 116*a* of the second electrode 116 face each other with a space therebetween. According this, the sustain discharge between the first electrode 115 and the second electrode 116 is induced by an opposed discharge, and thus the discharge firing voltage of the sustain discharge can be reduced.

The first portion 115*a* of the first electrode 115 and the third portion 116*a* of the second electrode 116 have different shapes.

First, the first portion 115*a* of the first electrode 115 and 116 protrudes more inside the discharge cell 128 near the rear substrate 10 than near the front substrate 20. Accordingly, the length of the first portion 115*a* along the first direction (e.g., the y-axis direction) is longer near the rear substrate 10 than near the front substrate 20.

Further, the length of a portion of the first portion 115*a* near the rear substrate 10 along the second direction is shorter than that of another portion of the base portions 115*a* and 116*a* near the front substrate 20.

In the second embodiment, as shown in FIG. 13, the first portion 115*a* of the first electrode 115 includes at least two electrode layers, each having different lengths in the first direction and the second direction (e.g., the x-axis direction). Though the first portion 115*a* includes three electrode layers in the second embodiment, the present invention us not limited to this configuration.

The first portion 115*a* of the first electrode 115 is structured so that t12 is longer than t11 and t13 is larger than t12. Here, t11, t12, and t13 are respective lengths of the electrode layer A11, the electrode layer A12, and the electrode layer A13 of the first portion 115*a* in the first direction (y-axis direction).

The length of the first portion 115*a* of the first electrode 115 in the first direction increases in a stepwise or incremental fashion from the electrode layer A11 which is close to the front substrate 20 to the electrode layer A13 which is close to the rear substrate 10. Therefore, the cross-section of the first portion 115*a* which is perpendicular to the second direction is a step shape in which the length increases stepwise from the electrode layer A11 which is close to the front substrate 20, to the electrode layer A13 which is close to the rear substrate 10.

The first portion 115*a* of the first electrode 115 may be structured so that l12 is shorter than l11 and l13 is shorter than l12. Here, l11, l12, and l13 are respective lengths of the electrode layer A11, the electrode layer A12, and the electrode layer A13 of the first portion 115*a* of the first electrode 115 in the second direction (x-axis direction).

The length of the first portion 115*a* of the first electrode 115 in the second direction decreases in a stepwise or incremental fashion from the electrode layers A11 which is close to the front substrate 20, to the electrode layer A13 which is close to the rear substrate 10. Therefore, the cross-section of the first portion 115*a* which is perpendicular to the first direction is a step shape in which the length decreases stepwise from the electrode layer A11 which is close to the front substrate 20, to the electrode layer A13 which is close to the rear substrate 10.

Next, the third portion 116*a* of the second electrode 116 has uniform lengths T3, W3 and L3 in the first direction (e.g., a y-axis direction), the second direction (e.g., a x-axis direction) and the third direction (e.g., a y-axis direction) perpendicular to the rear substrate 10 from the portion near the rear substrate 10 to the portion near the front substrate 20, respectively.

The length L3 of the third portion 116*a* in the third direction is longer than the length T3 of the third portion 116*a* in the first direction. And the third portion 116*a* has an enough length W3 in the second direction to correspond a discharge space of the discharge cell. Accordingly, an opposed discharge between the first portion 115*a* of the first electrode 115 and the third portion 116*a* of the second electrode 116 is stably generated by having a wide opposite area.

In one embodiment of the present invention, the first electrodes 115 and the second electrodes 116 are disposed to be sequentially repeated in a pair of adjacent discharge cells 128 in the first direction. For example, the order of the electrodes may be a first electrode 115, followed by a second electrode 116, then a first electrode 115, and finally a second electrode 116.

A second dielectric layer 118 is formed to surround the first electrode 115 and second electrode 116. As shown in FIGS. 12 and 14, the second dielectric layer 118 is formed to extend along the second direction while surrounding each of the first electrode 115 and second electrode 116. A MgO protective film 119 may be formed to cover the first dielectric layer 14 and the second dielectric layer 118.

In the second embodiment, the first electrode 115 protrudes toward the second electrode 116 more near the rear substrate 10. Thus, the first electrode 115 and the second electrode 116 have a short gap near the rear substrate 10 and have a long gap near the front substrate 20. Accordingly, the discharge is fired across the short gap near the rear substrate 10 and is diffused across the long gap close to the front substrate 20. Therefore, the discharge firing voltage can be reduced and the discharge efficiency can be simultaneously enhanced.

The length of each portion A13 of the first portion 115*a* along the first direction near the rear substrate 10 is longer than the length of each portion A11 of the first portion 115*a* near the front substrate 20, such that a weak short gap discharge can be induced and an intense long gap discharge can be induced. That is, in the second embodiment, with the intense long gap discharge, the discharge efficiency can be enhanced.

Hereinafter, modifications of the second embodiment of the present invention will be described. The modifications of the second embodiment have the same basic configuration as that of the second embodiment and the parts in the modifications are represented by the same reference numerals as the corresponding parts in the second embodiment.

Figure 15:
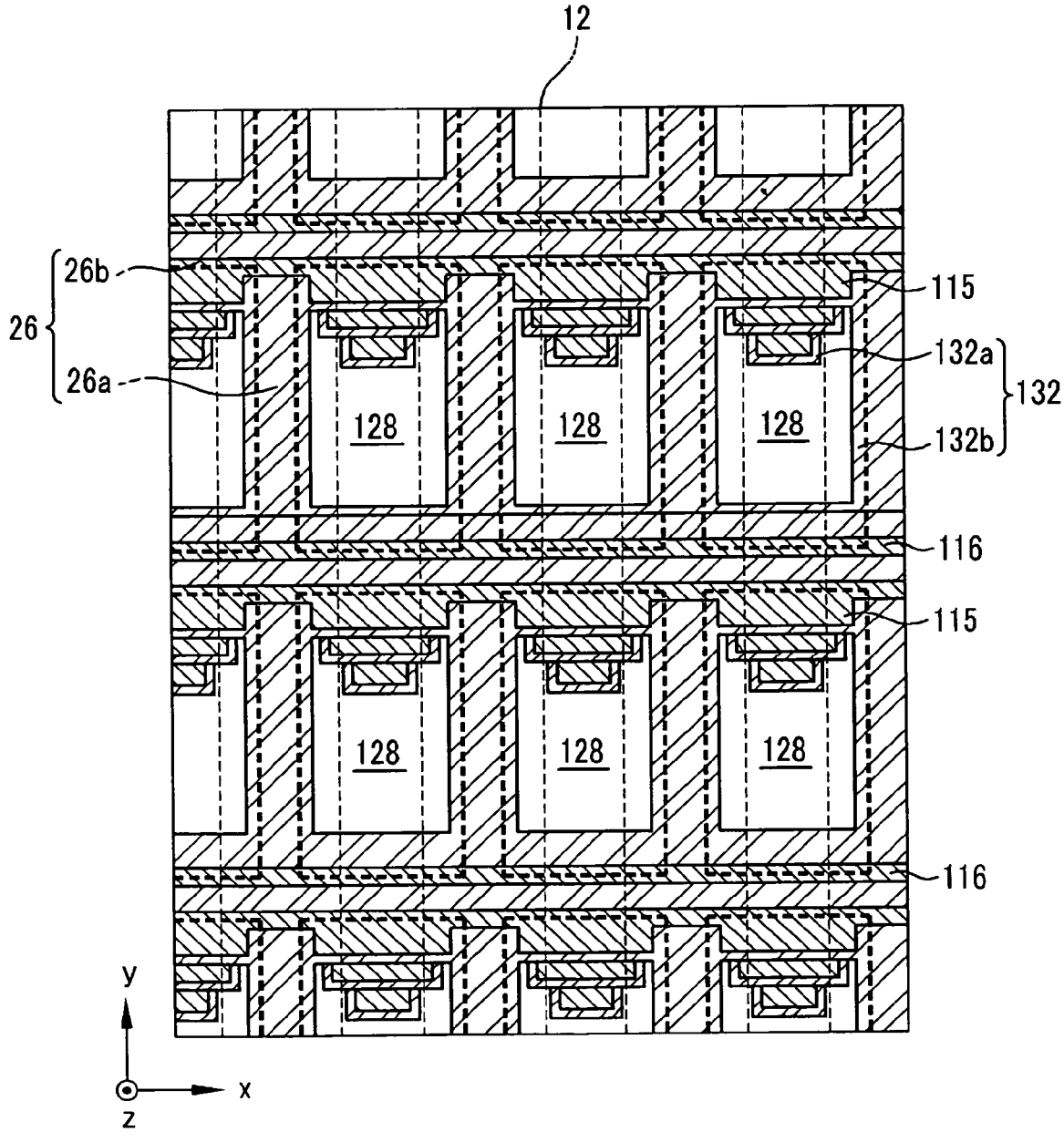
FIG. 15 is a partial plan view illustrating a plasma display panel according to a first modification of the second embodiment of the present invention.

FIG. 15 is a partial plan view illustrating a plasma display panel according to a first modification of the second embodiment of the present invention.

In the first modification, a second dielectric layer 132 has a first dielectric layer portion 132*a* that is formed in the second direction (e.g., the x-axis direction) to surround the first and second electrodes 115 and 116 and a second dielectric layer portion 132*b* that is formed in the first direction (e.g., the y-axis direction). The second dielectric layer portion 132*b* allows the discharge in the respective discharge cells to be controlled more accurately.

Figure 16:
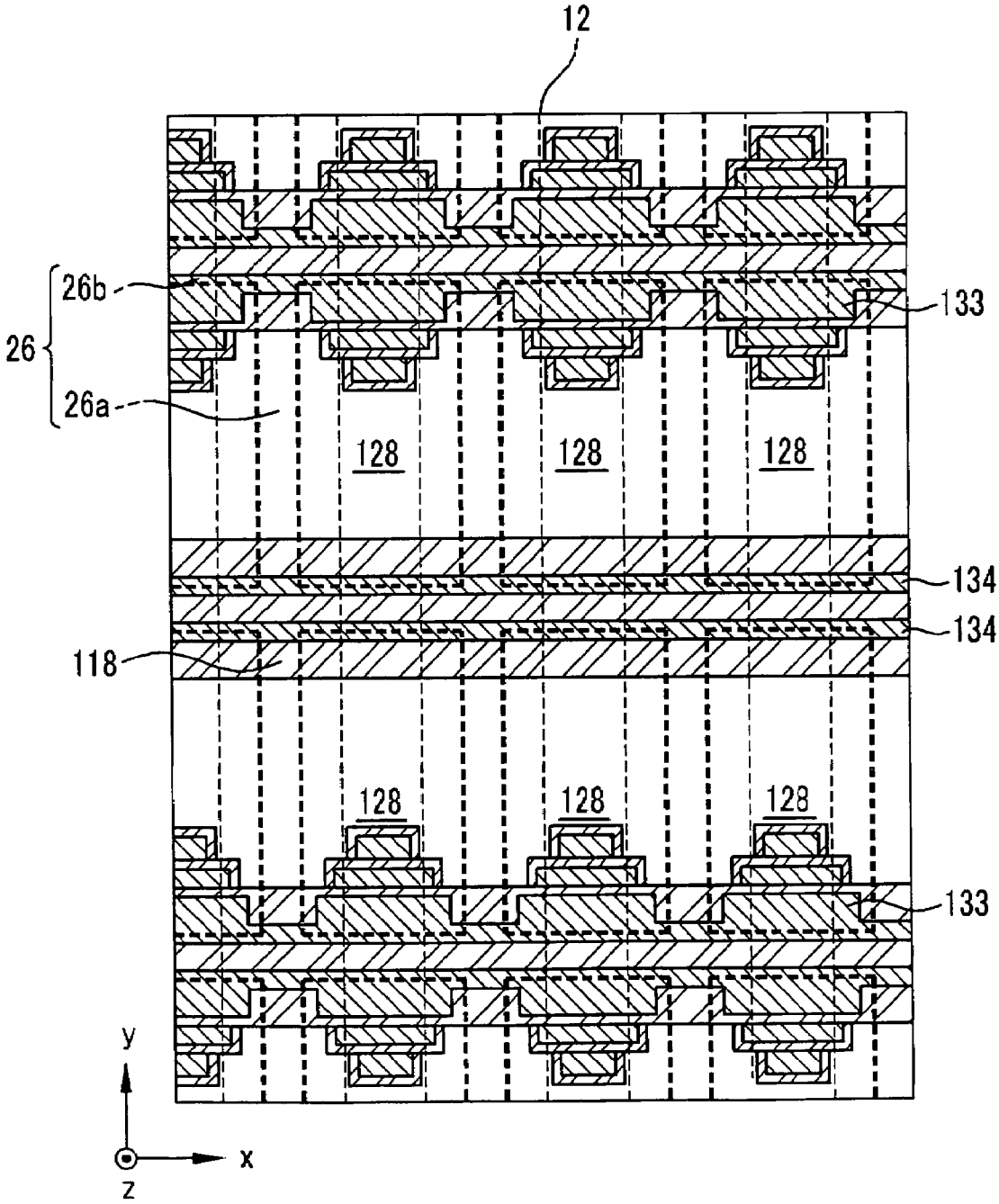
FIG. 16 is a partial plan view illustrating a plasma display panel according to a second modification of the second embodiment of the present invention.

FIG. 16 is a partial plan view illustrating a plasma display panel according to a second modification of the second embodiment of the present invention.

In the second modification, first and second electrodes 133 and 134 are disposed in adjacent discharge cells 128 in the first direction in a repeating order. The order may include first electrodes 133 adjacent to other first electrodes 133 and second electrodes 134 adjacent to other second electrodes 134. For example, a first electrode 133 may be followed by a second electrode 134, then another second electrode 134, and finally a first electrode 133.

Figure 17:
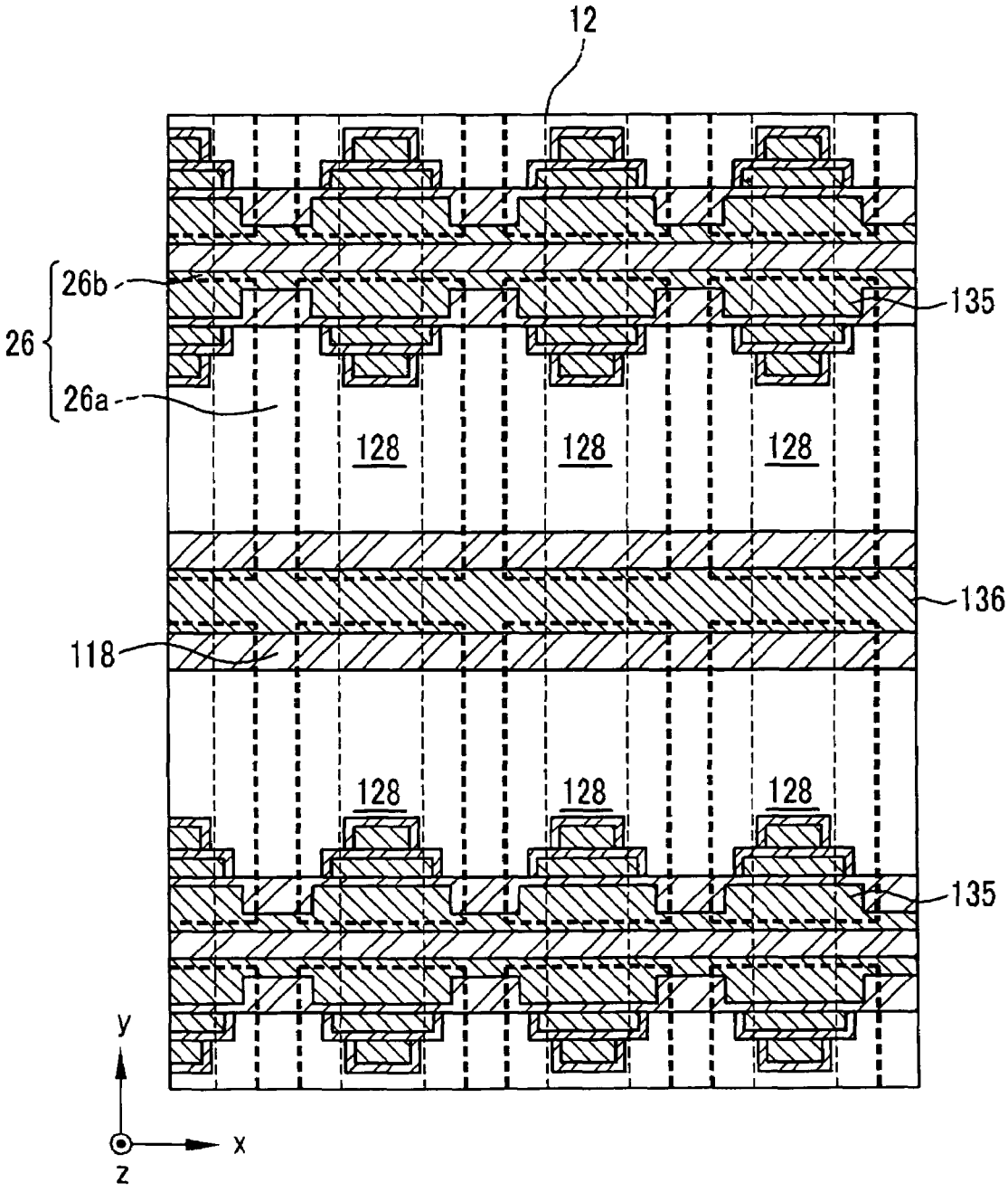
FIG. 17 is a partial plan view illustrating a plasma display panel according to a third modification of the second embodiment of the present invention.

FIG. 17 is a partial plan view illustrating a plasma display panel according to a third modification of the second embodiment of the present invention.

In the third modification, a second electrode 136 is formed to be shared by adjacent discharge cells 128 in the first direction (e.g., the y-axis direction). In the third modification, for example, an address discharge is generated by applying a voltage to a first electrode 135 and an address electrode 12. A sustain discharge is generated by alternately applying a voltage to the first electrode 135 and the second electrode 136.

The arrangement of the electrodes of the present invention is not limited to the above-described structure. Selectively, a second electrode may be separately formed to correspond each of discharge cells in the first direction, and a first electrode may be formed to be shared by a pair of adjacent discharge cells in the first direction. Further, a first electrode and a second electrode may be formed to be shared by a pair of adjacent discharge cells in the first direction. That is, various other types of arrangement of electrodes can be applied to the present invention.

Figure 18:
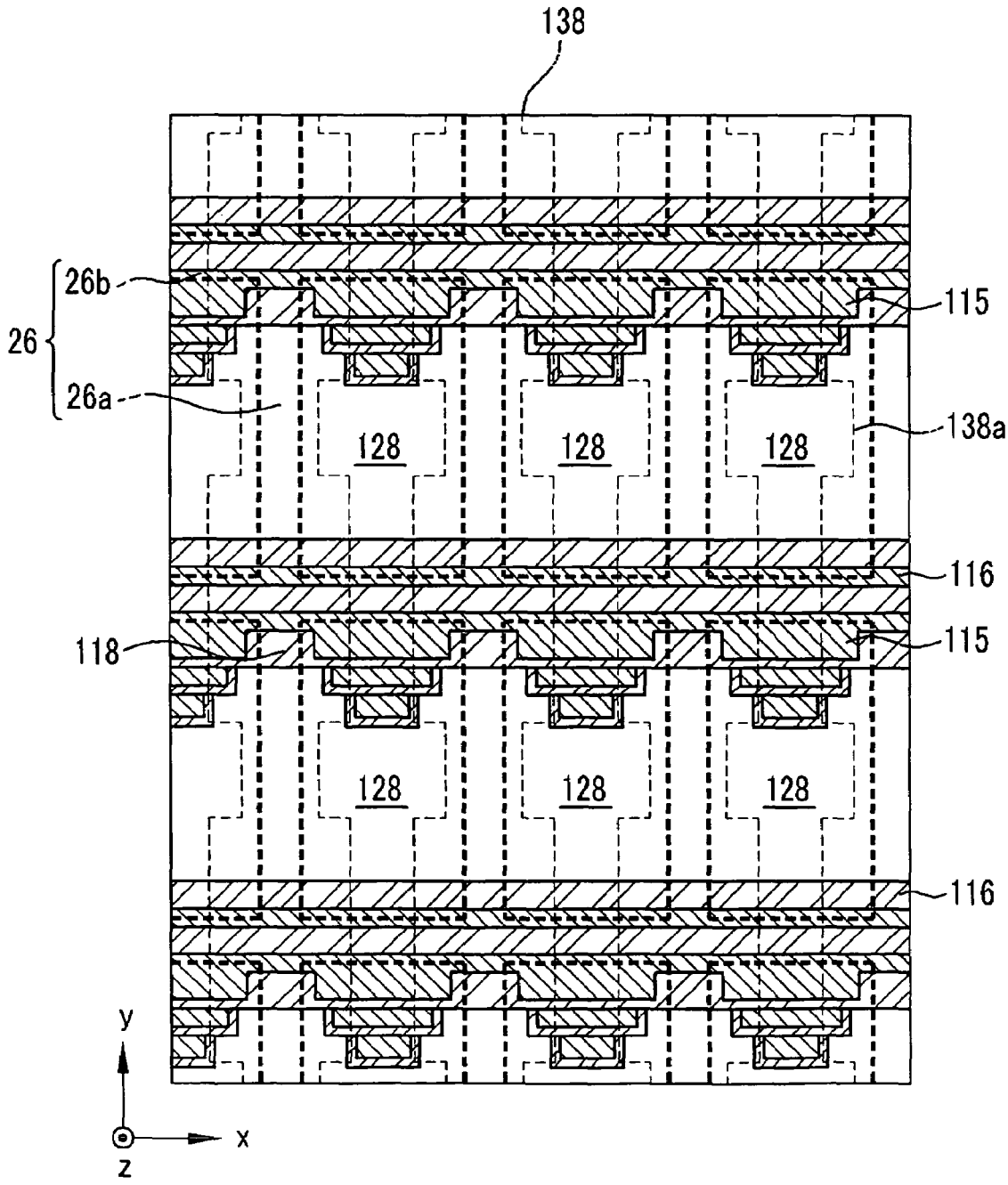
FIG. 18 is a partial plan view illustrating a plasma display panel according to a fourth modification of the second embodiment of the present invention.

FIG. 18 is a partial plan view illustrating a plasma display panel according to a fourth modification of the second embodiment of the present invention.

As shown in FIG. 18, in the fourth modification, a protruding portion 138*a* is formed in a portion of an address electrode 138 corresponding to a space between the first electrode 115 and the second electrode 116. Accordingly, in the fourth modification, the efficiency of the address discharge can be enhanced.

Figure 19:
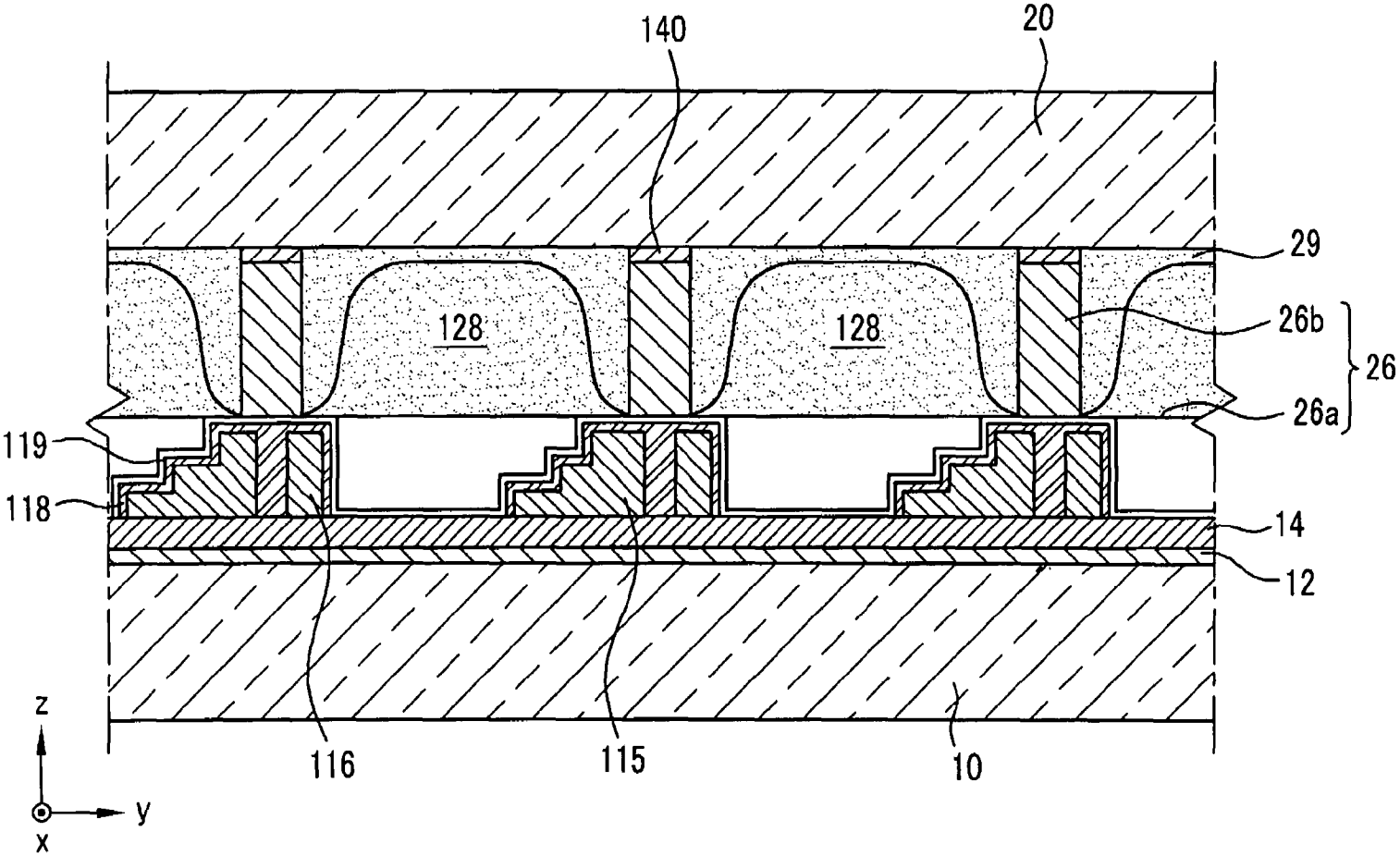
FIG. 19 is a cross-sectional view illustrating a plasma display panel according to a fifth modification of the second embodiment of the present invention.

FIG. 19 is a cross-sectional view illustrating a plasma display panel according to a fifth modification of the second embodiment of the present invention.

As shown in FIG. 19, in the fifth modification, a black layer 140 is formed on the front substrate 20 between the front substrate 20 and the barrier rib 26. Such a black layer 140 prevents the reflectance of external light and thus enhances the contrast of the plasma display panel.

Figure 20:
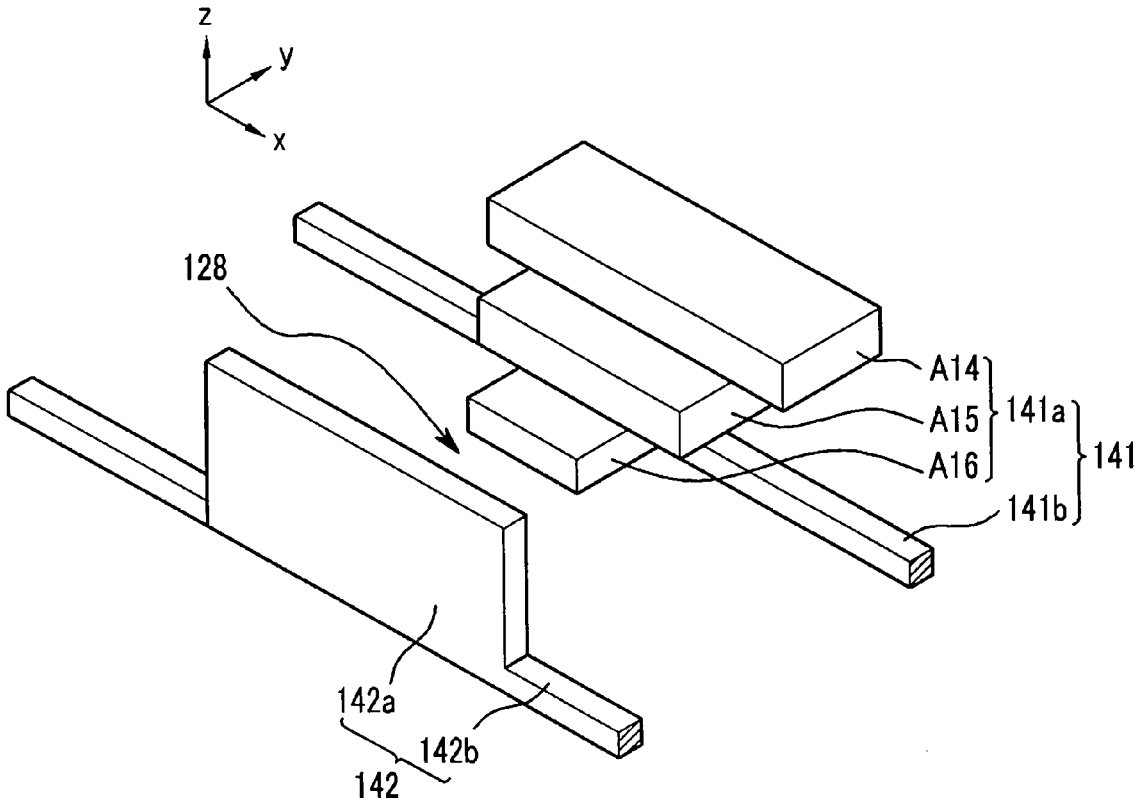
FIG. 20 is a partial perspective view illustrating a first electrode and a second electrode that correspond to a discharge cell in the plasma display panel according to a sixth modification of the second embodiment of the present invention.

FIG. 20 is a partial perspective view illustrating a first electrode and second electrode that correspond to a discharge cell in the plasma display panel according to a sixth modification of the second embodiment of the present invention.

In the sixth modification, a second portion 141*b* of first electrode 141 is formed to connect an electrode layer A16 of the first portion 141*a*, consisting of electrode layers A14, A15 and A16, near the rear substrate (not shown). The fourth portion 142*b* of the second electrode 142 is also formed near the rear substrate (not shown) to connect the third portions 142*a* of the second electrode 142.

Figure 21:
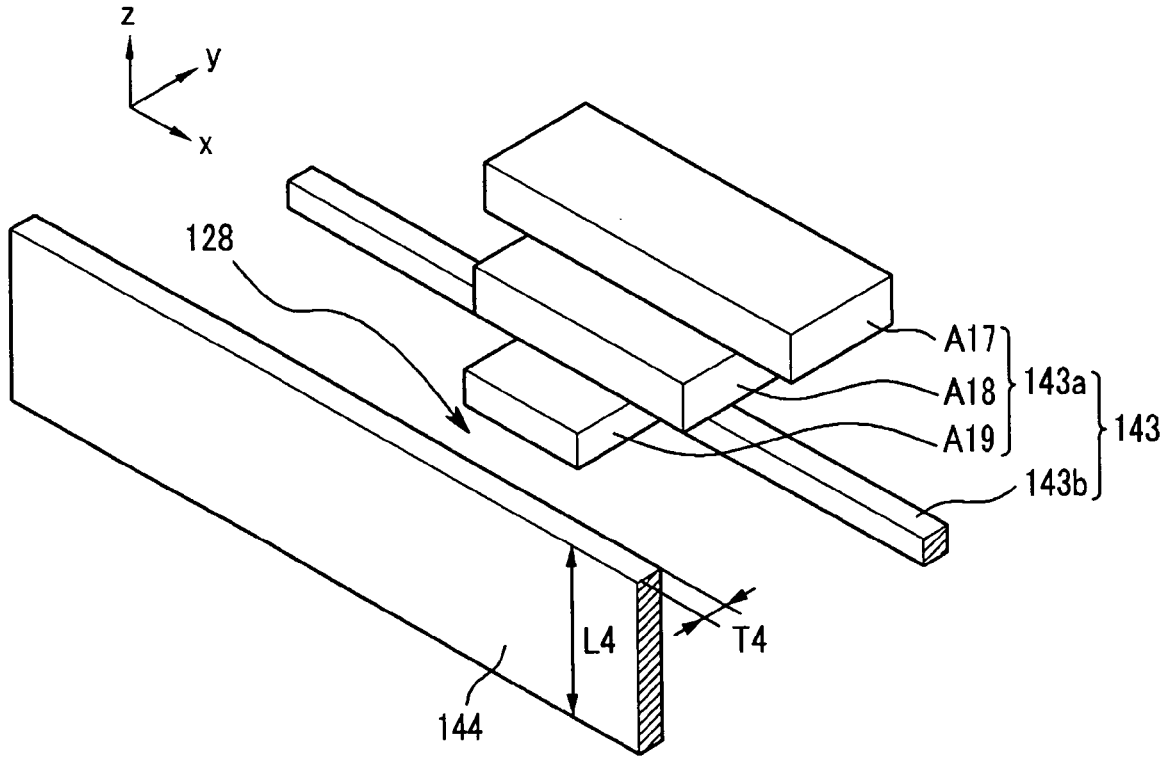
FIG. 21 is a partial perspective view illustrating a first electrode and a second electrode that correspond to a discharge cell in the plasma display panel according to a seventh modification of the second embodiment of the present invention.

FIG. 21 is a partial perspective view illustrating a first electrode and second electrode that correspond to a discharge cell in the plasma display panel according to a seventh modification of the second embodiment of the present invention.

The first electrode 143 includes first portions 143*a* that correspond to each discharge space of each discharge cell 128, and second portions 143*b* that connect adjacent ones of the first portions 143*a* along the second direction (e.g., the x-axis direction). The first portion 143*a* includes at least two electrode layers A17, A18 and A19 having different lengths in the second direction (e.g., the x-axis direction) and in the first direction (e.g., the y-axis direction), respectively.

And, referring to FIG. 21, the second electrode 144 has a stripe shape extending along the second direction. The second electrode 144 has uniform lengths T4 and L4 in the first direction (e.g., the y-axis direction) and in the third direction (e.g., the z-axis direction), respectively.

The length L4 in the third direction is longer than the length T4 in the first direction, and thus it facilitates a sustain discharge which is induced by an opposed discharge.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel, comprising:

a first substrate and a second substrate disposed to face each other, a space between the first substrate and the second substrate being divided into a discharge cell;

a phosphor layer formed in the discharge cell;

an address electrode for the discharge cell, the address electrode being formed in a first direction; and a first electrode and a second electrode for the discharge cell, the first electrode and the second electrode being formed in a second direction crossing the first direction, the first electrode and the second electrode being electrically isolated from the address electrode, a shape of the first electrode being substantially different from a shape of the second electrode, wherein the first electrode has a first portion that corresponds to a discharge space of the discharge cell, and a second portion that is connected to the first portion and formed along the second direction, wherein the first portion and the second electrode face each other with a space therebetween in the discharge cell, and wherein a length in the second direction of a portion of the first portion near the first substrate is different from a length in the second direction of another portion of the first portion near the second substrate.

2. The plasma display panel of claim 1, wherein the length in the second direction of the portion of the first portion near the first substrate is longer than the length in the second direction of the portion of the first portion near the second substrate.

3. The plasma display panel of claim 1, wherein the length in the second direction of the portion of the first portion near the first substrate is shorter than the length in the second direction of the portion of the first portion near the second substrate.

4. The plasma display panel of claim 1, wherein the portion of the first portion near the first substrate protrudes inside the discharge cell more than the portion of the first portion near the second substrate.

5. The plasma display panel of claim 1, wherein a portion of the second electrode to correspond the discharge space of the discharge cell has uniform lengths in the first direction and a third direction perpendicular to the first substrate, respectively.

6. A plasma display panel, comprising:

a first substrate and a second substrate disposed to face each other, a space between the first substrate and the second substrate being divided into a discharge cell;

a phosphor layer formed in the discharge cell;

an address electrode formed in a first direction; and a first electrode and a second electrode for the discharge cell, the first electrode and the second electrode being formed in a second direction crossing the first direction, the first electrode and the second electrode being electrically isolated from the address electrode, a shape of the first electrode being substantially different from a shape of the second electrode, wherein the first electrode has a first portion that corresponds to a discharge space of the discharge cell, and a second portion that is connected to the first portion and formed along the second direction, wherein the first portion and the second electrode face each other with a space therebetween in the discharge cell, and wherein the first portion includes electrode layers having different lengths in at least one of the first direction and the second direction.

7. The plasma display panel of claim 6, wherein the first electrode has a stepped shape.

8. The plasma display panel of claim 6, wherein the electrode layers become longer stepwise toward the first substrate in the second direction.

9. The plasma display panel of claim 6, wherein the electrode layers become shorter stepwise toward the first substrate in the second direction.

10. The plasma display panel of claim 6, wherein the electrode layers protrude more inside the discharge cell stepwise toward the first substrate.

11. The plasma display panel of claim 6, wherein a first electrode layer, of the electrode layers, near the first substrate is wider than another electrode layer, of the electrode layers, nearer the second substrate.

12. The plasma display panel of claim 6, wherein the second portion is connected to the electrode layer, of the electrode layers, nearest the first substrate.

13. The plasma display panel of claim 6, further comprising:

a first dielectric layer that is formed on the first substrate covering the address electrode, and a second dielectric layer that surrounds the first electrode and the second electrode to form a space between the first electrode and the second electrode in the discharge cell.

14. The plasma display panel of claim 13, wherein the second dielectric layer extends along the second direction to surround the first electrode and the second electrode.

15. The plasma display panel of claim 13, wherein the second dielectric layer includes a first dielectric layer portion that is formed along the second direction to surround the first electrode or the second electrode, and a second dielectric layer portion that is formed in the first direction.

16. The plasma display panel of claim 6, wherein the discharge cell comprises a plurality of discharge cells, wherein at least one of the first electrode and the second electrode is commonly shared by adjacent ones of the discharge cells in the first direction.

17. The plasma display panel of claim 6, further comprising:

at least one barrier rib formed on the second substrate above the first and second electrodes to divide into the discharge cell.

18. The plasma display panel of claim 6, wherein, in a space between the first electrode and the second electrode, the address electrode has a protruding portion that expands outward, in the second direction, from both sides of the address electrode.

19. The plasma display panel of claim 6, wherein the second electrode has a first portion that corresponds to the discharge space of the discharge cell, and a second portion that is connected to the first portion of the second electrode and formed along the second direction, wherein the first portion of the second electrode has uniform lengths in the first direction and a third direction perpendicular to the first substrate, respectively.

20. The plasma display panel of claim 6, wherein the second electrode has a stripe shape with uniform lengths in the first direction and a third direction perpendicular to the first substrate, respectively.

* * * * *